US010487458B2

(12) United States Patent
Harman

(10) Patent No.: US 10,487,458 B2
(45) Date of Patent: Nov. 26, 2019

(54) SYSTEM AND METHOD FOR PLACEMENT OF RAILROAD TIE PLATE

(71) Applicant: Jeffrey Kyle Harman, Hiwassee, VA (US)

(72) Inventor: Jeffrey Kyle Harman, Hiwassee, VA (US)

( * ) Notice: Subject to any disclaimer, the term of this patent is extended or adjusted under 35 U.S.C. 154(b) by 519 days.

(21) Appl. No.: 15/090,142

(22) Filed: Apr. 4, 2016

(65) Prior Publication Data

US 2016/0289900 A1 Oct. 6, 2016

Related U.S. Application Data

(60) Provisional application No. 62/297,794, filed on Feb. 19, 2016, provisional application No. 62/286,457, filed on Jan. 25, 2016, provisional application No. 62/143,175, filed on Apr. 5, 2015.

(51) Int. Cl.
*E01B 29/32* (2006.01)

(52) U.S. Cl.
CPC ..... *E01B 29/32* (2013.01)

(58) Field of Classification Search
CPC ..... E01B 29/24; E01B 29/26; E01B 29/32
USPC ..... 104/5, 16
See application file for complete search history.

(56) References Cited

U.S. PATENT DOCUMENTS

| | | | | |
|---|---|---|---|---|
| 4,280,613 | A * | 7/1981 | Stewart | E01B 29/24 104/16 |
| 4,974,518 | A * | 12/1990 | Cotic | E01B 29/32 104/16 |
| 6,595,140 | B1 * | 7/2003 | Madison | E01B 29/32 104/16 |
| 8,132,512 | B2 * | 3/2012 | Helmick | E01B 29/32 104/16 |
| 8,166,883 | B1 * | 5/2012 | Coots | E01B 29/32 104/16 |
| 9,156,623 | B1 * | 10/2015 | Buzdum | B65G 27/04 |
| 2013/0247794 | A1 * | 9/2013 | Coots | E01B 29/32 104/2 |
| 2014/0251175 | A1 * | 9/2014 | Harman | E01B 29/32 104/16 |

* cited by examiner

*Primary Examiner* — Zachary L Kuhfuss
(74) *Attorney, Agent, or Firm* — Studebaker & Brackett PC

(57) ABSTRACT

The disclosed railroad tie plate placement system facilitates or enables a railroad crew to minimize interaction with railroad tie plates while placing railroad tie plates in a proper orientation on a railroad or railway track in preparation for insertion under a rail. Thus, the railroad tie plate placement system of the present disclosure reduces labor costs and decreases risk of injury while providing for consistent placement of tie plates.

22 Claims, 18 Drawing Sheets

FIG. 3
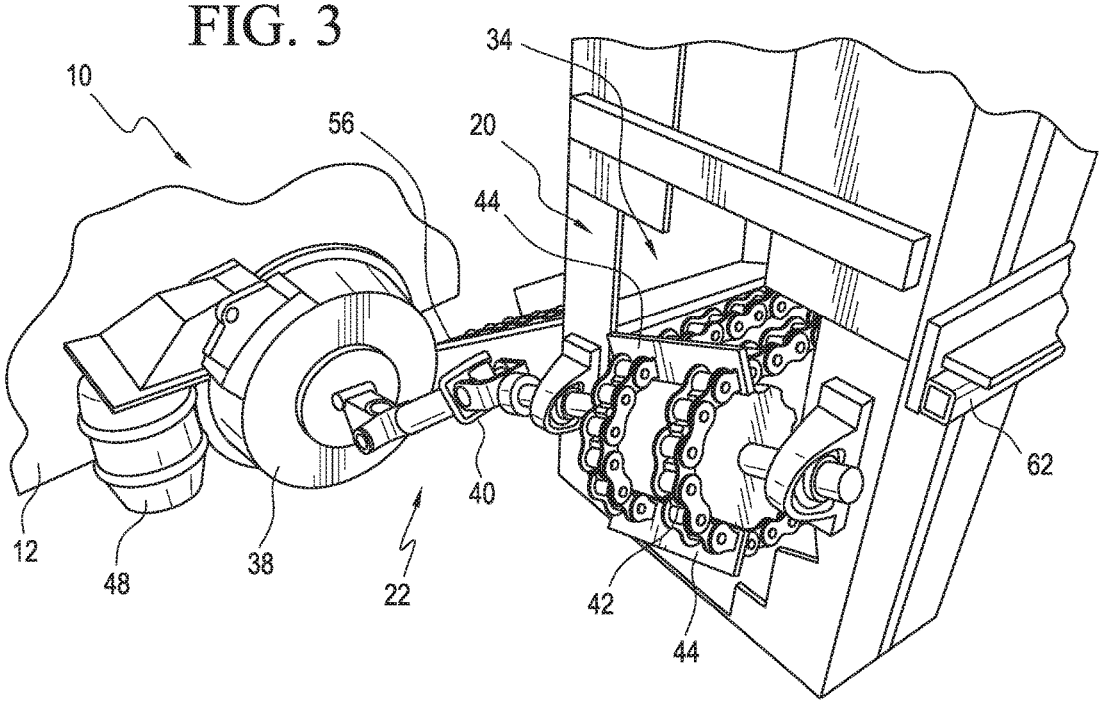
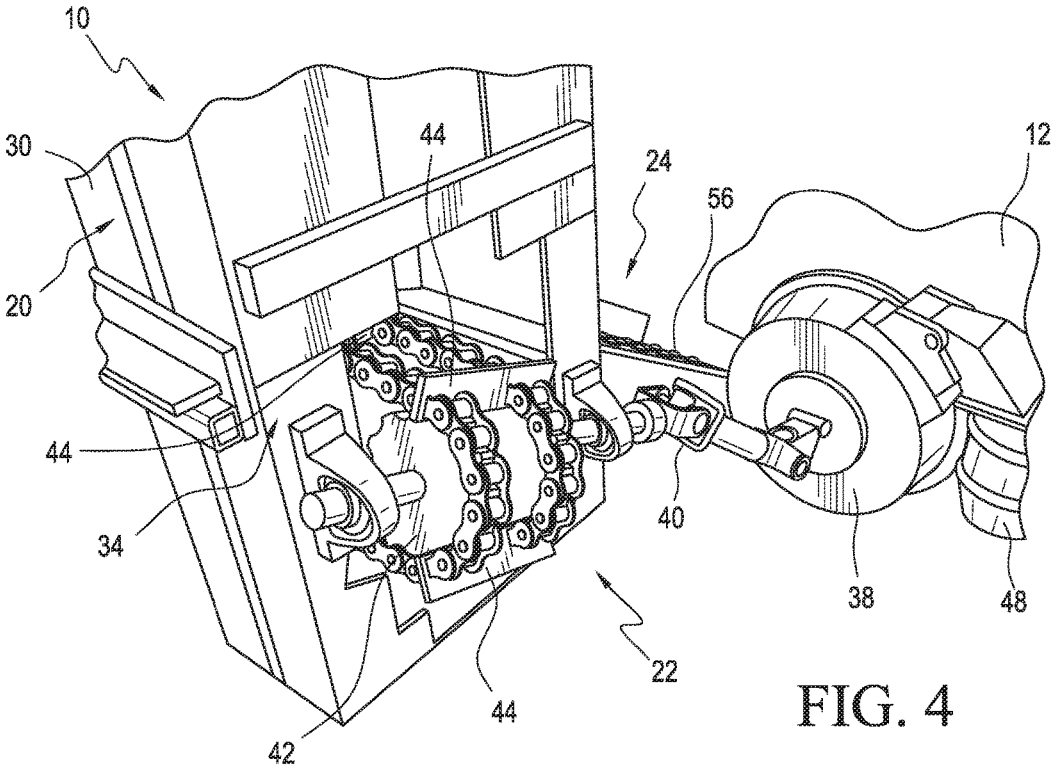
FIG. 4

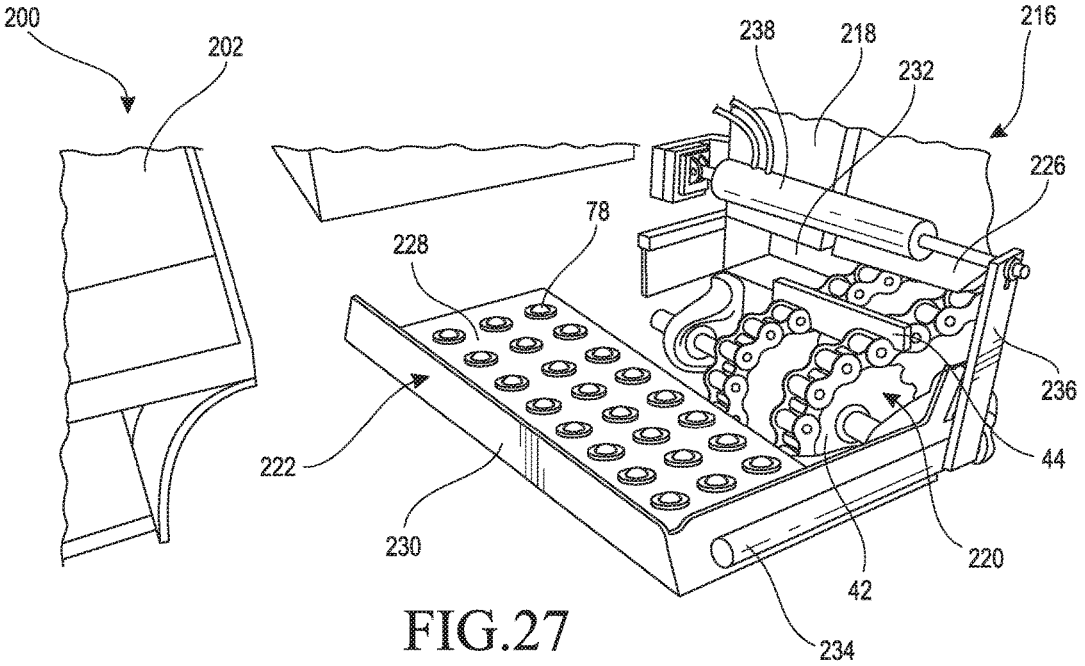
FIG.27
FIG.28
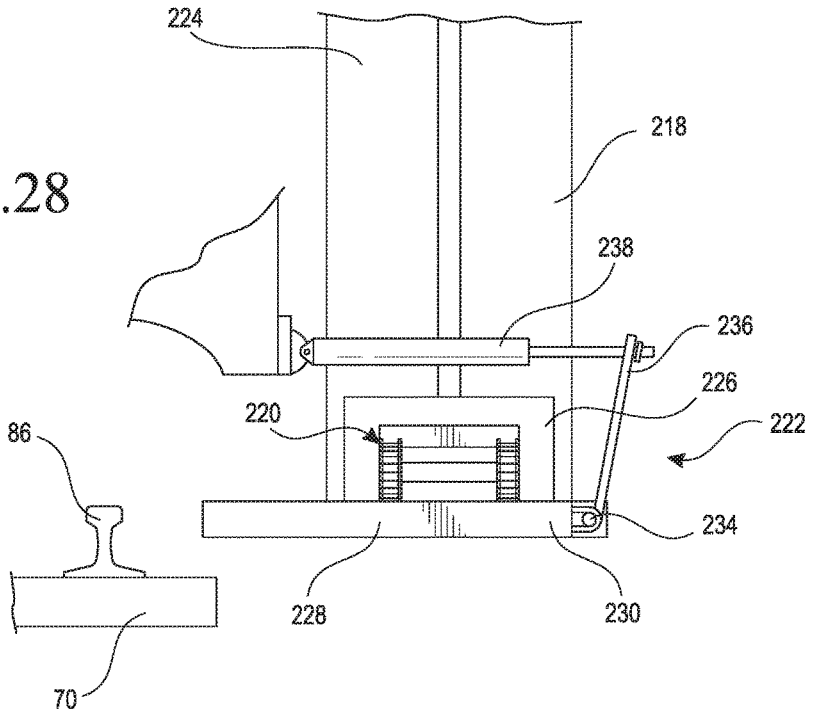

SYSTEM AND METHOD FOR PLACEMENT OF RAILROAD TIE PLATE

CROSS-REFERENCE TO RELATED APPLICATIONS

This application claims the benefit of priority to U.S. Provisional Patent Application No. 62/143,175, filed on Apr. 5, 2015; 62/286,457, filed on Jan. 25, 2016; and 62/297,794, filed on Feb. 19, 2016, which are hereby incorporated by reference in their entirety.

TECHNICAL FIELD

This disclosure relates to systems for placing a railroad tie plate on a railroad track.

BACKGROUND

A railroad includes a pair of parallel metal rails interconnected and held in place by a plurality of crossties, also called railroad ties or ties, along a path of rocks or ballast. The rails are interconnected and held in place on the ties by positioning railroad tie plates between the rails and the ties. Railroad tie plates increase the load bearing surface area on the tie for a load on the rail generated by rail supported vehicles, typically train engines and train cars. The load on the rail is transferred from the rail to the tie through the railroad tie plate. In the past, metal railroad spikes were used to hold both the railroad tie plates and the rails in position on the ties. Today, spikes or lag bolts can be used to attach the railroad tie plate to the tie while the rail is attached to the tie plate using a fastener, such as a clip.

Historically, railroads were built using hand tools and manual labor. The equipment first used in the railroad construction industry was for clearing and preparing railway beds. Later, purpose built, custom built, or specialty equipment specifically designed for railroad construction was developed and used to construct railroads. Currently, the steps involved in building a railroad, including the setting of ties, laying of rail, grading of ballast, and driving spikes, is all done by railroad construction equipment specifically designed for such tasks. There is also railroad construction equipment that can effect repairs, such as tie replacement equipment that removes a tie from under the rails of an existing railroad track and then inserts a new tie, which is later spiked to a tie plate attached to the rails.

Purpose built railroad construction equipment is typically supported by other material handling equipment. For example, front-end loaders and dump trucks preposition ballast for railway ballast grading equipment. In another example, excavators with mechanical claws preposition ties for railway tie setting equipment. Regardless of the equipment custom built to build railroads, manual labor is still used to preposition railway tie plates for railway tie plate installation equipment. That is, manual labor is done to specifically position a pair of railway tie plates near, on, or between the rails so that railway tie plate installation equipment can later acquire the railway tie plates and install the railway tie plates between the ties and the rails.

SUMMARY

This disclosure provides a railroad tie plate placement system comprising a vehicle, a chute ramp, and a system positioned on the vehicle for placing the railroad tie plate on the chute ramp. The vehicle includes a plurality of flanged wheels sized and dimensioned to support the vehicle on a railroad track having a pair of railroad rails. The railroad rails are supported by a plurality of railroad ties. The vehicle includes a left side and a right side. The chute ramp is positioned on the vehicle and is oriented to extend from one of the left side and a right side toward the pair of railroad rails. The chute ramp includes a first end positioned at the one of the left side and the right side, and a second positioned at a location between the left side and the right side. The system is configured to place the railroad tie plate at the first end.

This disclosure also provides a system for depositing a railroad tie plate on a railroad track that includes a pair of rails and a plurality of railroad ties, the system comprising a vehicle and a chute ramp. The vehicle having a left side and a right side. The vehicle is configured to be supported by the pair of rails. The chute ramp is positioned on the vehicle and is oriented to be approximately parallel to the railroad ties when the vehicle is supported by the pair of rails. The chute ramp is also configured to receive the railroad tie plate at one of the left side and the right side and to deposit the railroad tie plate on the railroad track.

Advantages and features of the embodiments of this disclosure will become more apparent from the following detailed description of exemplary embodiments when viewed in conjunction with the accompanying drawings.

BRIEF DESCRIPTION OF THE DRAWINGS

FIG. 3 shows a perspective view of another portion of the right side of the railroad tie plate placement system of FIG. 2.

FIG. 4 shows a perspective view of another portion of a left side of railroad tie plate placement system of FIG. 2.

FIG. 27 shows a view of a portion of the railroad tie placement system of FIG. 26 with a chute ramp in a first position.

FIG. 28 shows an elevation view of the chute ramp of FIG. 27 positioned along a railroad track.

DETAILED DESCRIPTION

Figure 1:
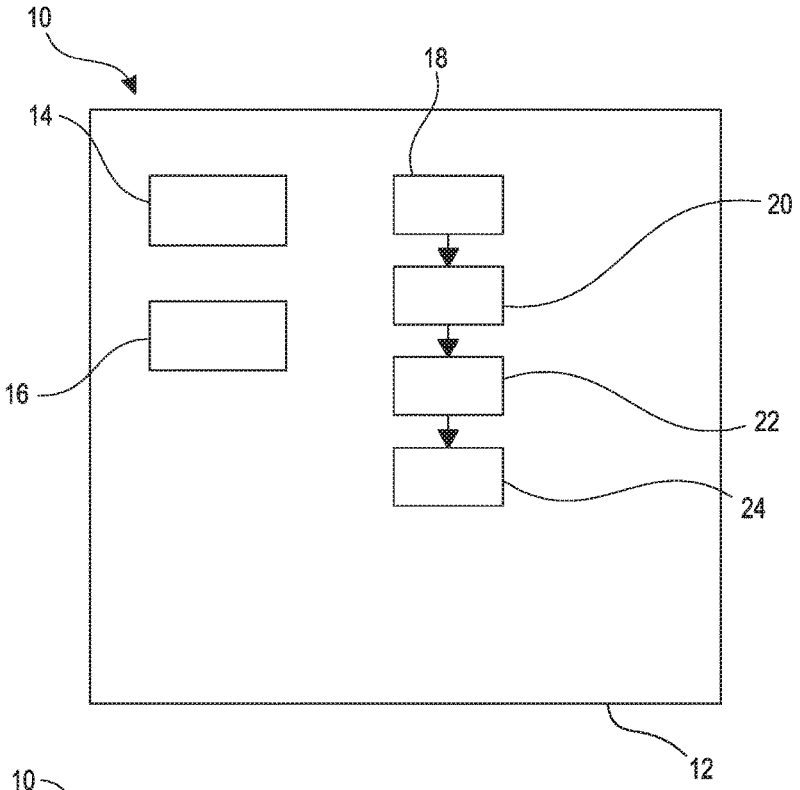
FIG. 1 shows a block diagram of a railroad tie placement system in accordance with an exemplary embodiment of the present disclosure.

Conventional manual placement of railroad tie plates has been the standard practice for placement of railroad tie plates for decades. However, such placement, while accurate, is labor and cost intensive. Furthermore, the risk of injury in such placement is high, leading to employee absenteeism due to injury, as well as the attendant medical and worker's compensation costs. The railroad tie plate placement systems of the present disclosure facilitate or enable a railroad crew to reduce physically handling railroad tie plates while placing railroad tie plates in a proper position and orientation on a railroad track in preparation for insertion under a rail by purpose built equipment. In an exemplary embodiment, placement may be on a railroad tie of the railroad track. Thus, the railroad tie plate placement systems of the present disclosure reduce labor costs and decrease risk of injury while providing for consistent placement of tie plates.

In the included figures, the thicknesses of layers and regions are exaggerated for clarity. In addition, perspectives may be distorted for clarity. Accordingly, the included figures are not to scale. Furthermore, it should be understood that like reference numerals in the embodiments of the figures denote like elements. Further yet, the term railroad and railway may be used synonymously in the context of this disclosure.

FIG. 1 shows a block diagram of a railroad tie placement system, indicated generally at 10, in accordance with an exemplary embodiment of the present disclosure. For the sake of brevity, railroad tie placement systems are described herein as placement systems. Placement system 10 includes a vehicle 12, which includes a propulsion system 14 and a high-rail system 16. Placement system 10 also includes a plate holding area or plate storage 18, a plate transport system 20, a plate transfer system 22, and a plate deposition system 24. Plate transport system 20 and plate transfer system 22 can be similar to the railroad tie plate dispenser described in co-pending U.S. patent application Ser. No. 14/194,948, filed Mar. 3, 2014, which is hereby incorporated by reference in its entirety.

Vehicle 12 can be, for example, a truck, such as a flatbed truck, or a purpose-built vehicle that includes an engine and drive wheels. Propulsion system 14 can be an integral internal combustion engine, an electric engine, a hybrid engine, and the like. In an alternative embodiment, propulsion system 14 is positioned as a separate vehicle entirely, and vehicle 12 does not include an integral propulsion system. When vehicle 12 begins as a highway capable vehicle with highway appropriate treaded tires and then has free-wheeling, i.e., non-powered, retractable, flanged wheels added to it to enable vehicle 12 to operate on train tracks, the added wheels can be described as high-rail system 16.

Plate storage 18, plate transport system 20, plate transfer system 22, and plate deposition system 24 will be described in more detail hereinbelow with respect to the following figures.

Figure 2:
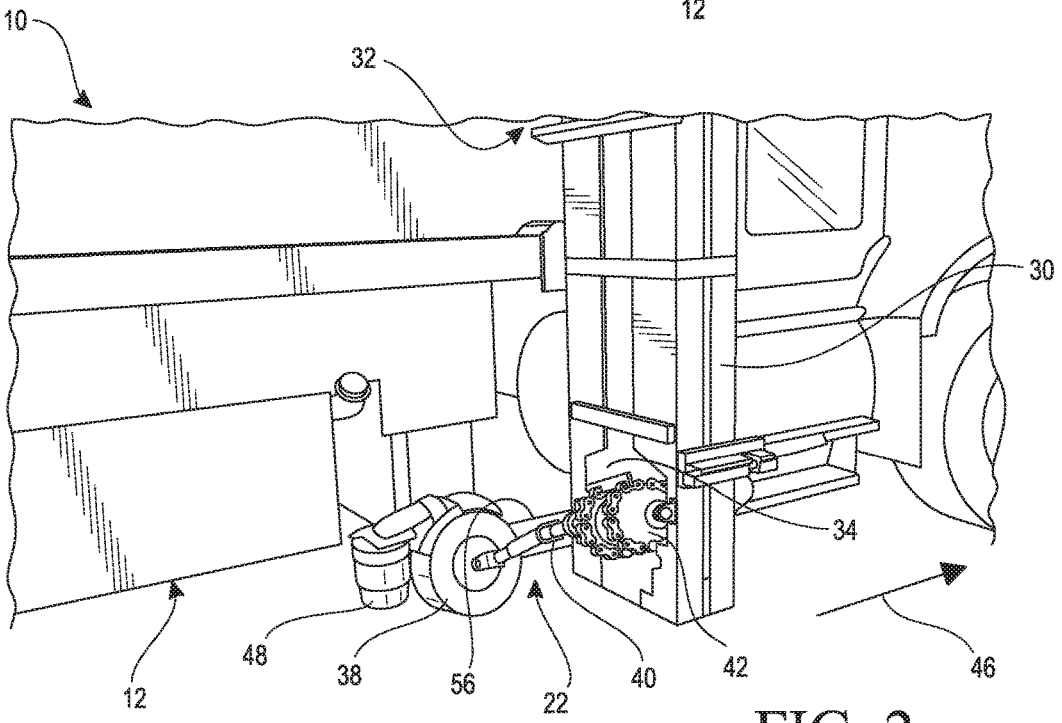
FIG. 2 shows a perspective view of a portion of a right side of a railroad tie plate placement system in accordance with an exemplary embodiment of the present disclosure.
Figure 5:
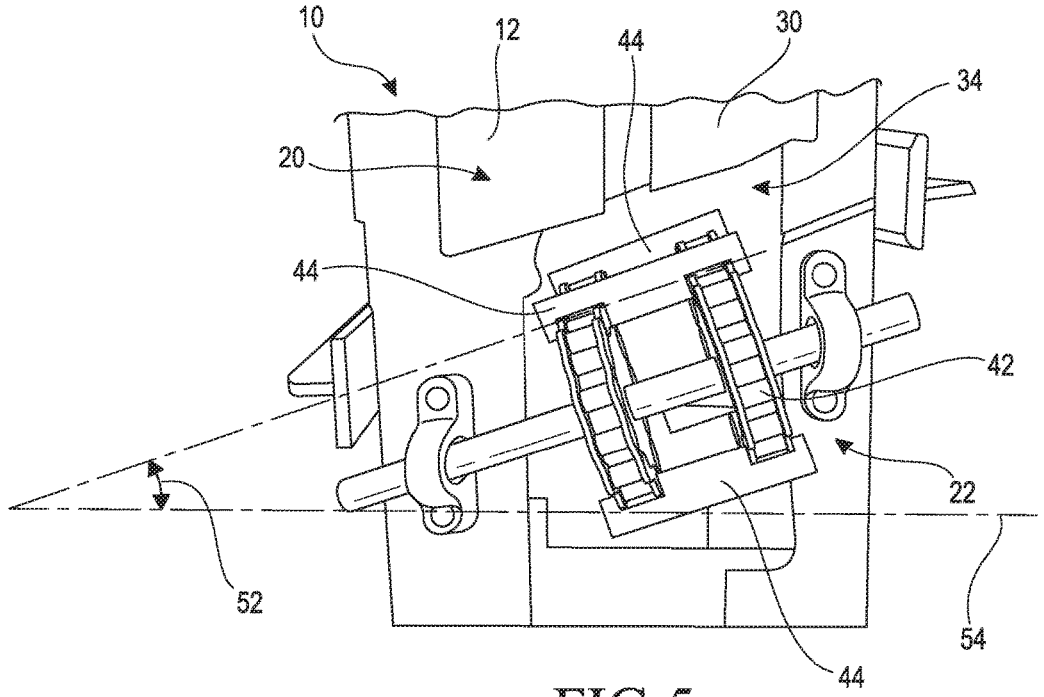
FIG. 5 shows a perspective view of still yet another portion of the right side of railroad tie plate placement system of FIG. 2.

FIGS. 2-16 show perspective views of a portion of placement system 10. As shown in, for example, FIG. 9, plate storage 18 can be positioned on, for example, a bed 26 of vehicle 12. Plate transport system 20 includes a hopper or loader 28 positioned at, on, near, or adjacent to bed 26, and above bed 26. As shown in, for example, FIG. 2, plate transport system 20 also includes a tie plate magazine, transport magazine, or transport box 30, which can be positioned on one or both sides of vehicle 12. Transport magazine or box 30 includes a first, upper end 32, which is positioned above bed 26, and a second, lower end 34, which is positioned below bed 26. Transport magazine 30 is filled with a plurality of railroad tie plates 36, such as that shown in FIG. 12, by way of loader 28 in the area of bed 26. Railroad tie plates 36 slide or drop through transport magazine or box 30 from first, upper end 32 down to second, lower end 34 under the force of gravity from above bed 26 to below bed 26. Railroad tie plates 36 can be positioned on loader 28 manually or with a device or apparatus.

Figure 9:
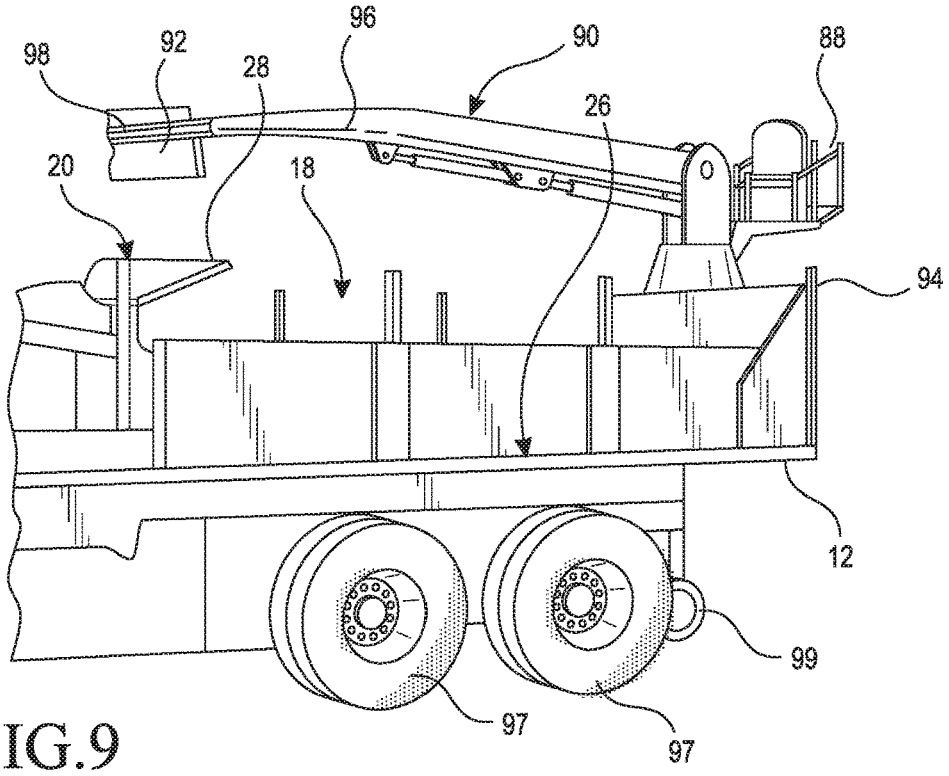
FIG. 9 shows a perspective view of yet an even further portion of the railroad tie plate placement system of FIG. 2.

As shown in FIG. 9, vehicle 12 can include a crow's nest 88 for operating a crane 90 with a magnetic lift 92. More specifically, crow's nest 88 is located at a back 94 of vehicle 12 where an operator is able to manipulate a boom 96 of crane 90, which is also positioned at rear 94 of vehicle 12. Magnetic lift 92 is positioned at a distal end 98 of boom 96 so that railroad tie plates 36 located in plate storage 18 on bed 26 of vehicle 12 can be lifted to loader 28, which is used in the loading of plate transport system 20. FIG. 9 also shows rear free-wheeling high-gear or railroad wheels 99 located at back 94 of vehicle 12. Rear free-wheeling high-gear 99 is retractable in that rear high-gear 99 can be lifted off the rail of the railway or railroad track or lowered onto the rail of the railway or railroad track by a hydraulic mechanism. The inside tires of dual tires 97 of vehicle 12 rest on the rails of the railways when vehicle 102 is deployed on a railway. Thus, the inside tires of dual tires 97 can be used as a drive tire to propel vehicle 12 down a railway while front high rail 16 and rear high rail 99 are lowered onto the rails of the railway.

Once railroad tie plates 36 drop to second, lower end 34, they are positioned adjacent to plate transfer system 22. Plate transfer system 22 includes a flanged drive wheel 38, a plurality of shafts and universal joints 40, and a paddle drive or chain drive 42. Chain drive 42 includes a plurality of push plates or paddles 44 that each push or move a single railroad tie plate 36 from second, lower end 34 of transport magazine or box 30 to plate deposition system 24. A vehicle operator can move flanged wheel 38, which can also be described as a by-gear or hi-gear, from a first raised position to a second lower position to contact a railroad track rail during motion or movement of vehicle 12. As vehicle 12 moves, flanged wheel 38 rotates, which causes shafts and universal joints 40 to similarly rotate. The rotation of shafts and universal joints 40, which includes a double U-joint universal joint configuration, causes chain drive 42 to move, moving push plates 44 in a direction that is transverse to a vertical direction. In the exemplary embodiment of FIG. 2, the direction of movement of chain drive 42 is along a length of vehicle 12, in a direction that is toward a front 46 of vehicle 12. However, in another embodiment, the movement of chain drive 42 can be toward vehicle 12, which can be effected by way of, for example, rotating chain drive 42 by approximately 90 degrees and connecting a right angle gear box between universal joints and shafts 40 and chain drive 42. Plate transfer system 22 also includes a brake system 48 for stopping the movement of flanged wheel 38, particularly when flanged wheel 38 is raised or when it is desirable to stop the movement of railroad tie plates 36 from plate transport system 20 to plate deposition system 24.

Figure 20:
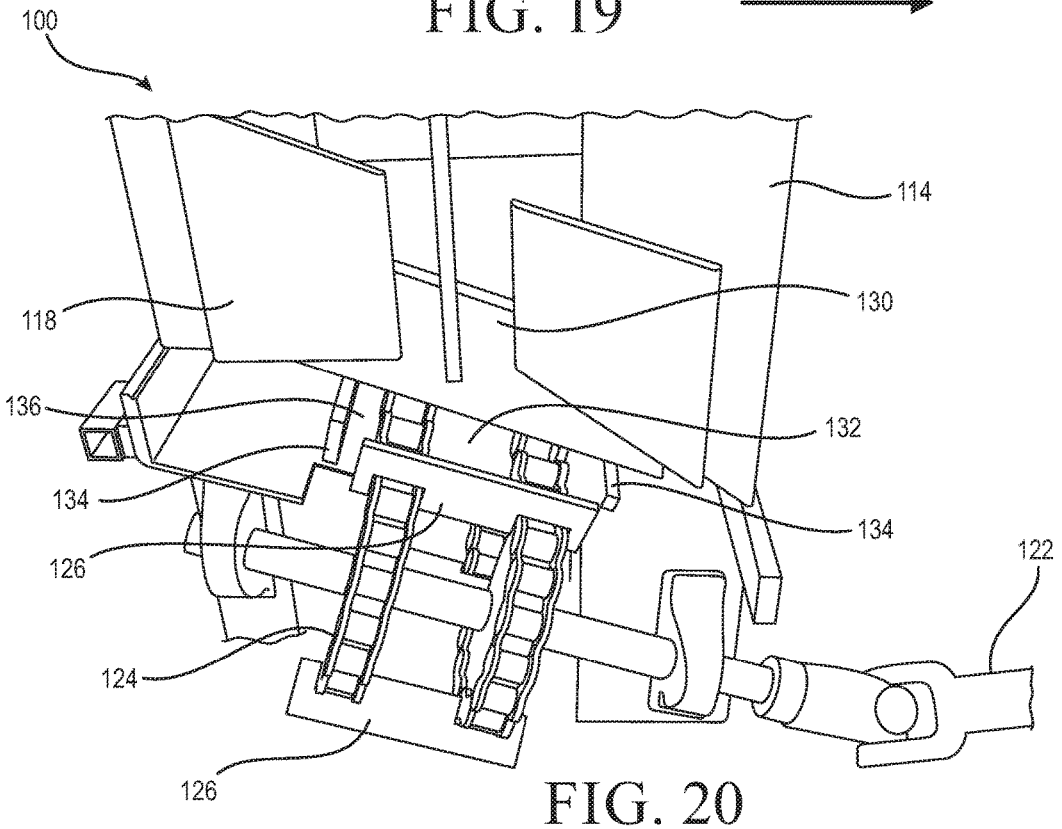
FIG. 20 shows a perspective view of another portion of the railroad tie plate placement system of FIG. 18.

Transport magazine 30 can further includes one or more plate rails 134, as shown in FIG. 20, to help keep railroad tie plates 36 oriented square to the sides of transport magazine 30 as railroad tie plates 36 are transferred from transport magazine 30 to plate deposition system 24. As can be seen in, for example, FIG. 5, in an exemplary embodiment railroad tie plates 36 can be dispensed at angle 52 with respect to a horizontal line or plane 54 the ground, or railroad tie plates 36 can be dispensed by plate transfer system 22 from plate transport system 20 at an angle at which plate deposition system 24 is oriented to receive railroad tie plate 36.

Plate deposition system 24 includes a chute ramp or slide chute 56 positioned adjacent or alongside transport magazine 30, extending at an angle from transport magazine 30 toward the ground and into an area or region below or under vehicle 12. In an exemplary embodiment, chute ramp 56 is oriented at a fixed angle that is approximately 5 degrees with respect to the ground. However, the angle can be adjusted based on the height of a top end of chute ramp 56 above the ground. It should be understood that limited space under vehicle 12 provides an upper practical limit to the angle. In addition, relatively high angles in conjunction with anti-friction bearings, described in more detail hereinbelow, can lead to uncontrollable deposition. Furthermore, it should also be understood that an extremely shallow angle leads to a long drop time or interval, which can be undesirable for high deposition rates. Accordingly, Applicant has found that an angle range of approximately 3 to 7 degrees provides a balance of deposition rate and controllability of deposition when chute ramp 56 is provided with a plurality of bearings to reduce friction to promote movement of railroad tie plates 36.

Figure 6:
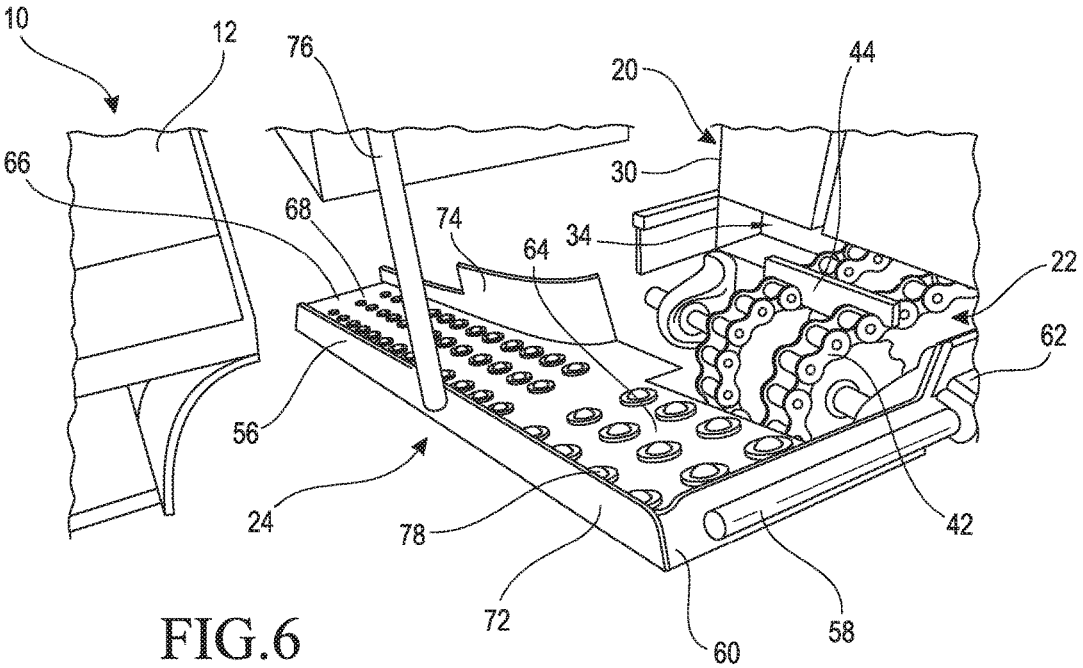
FIG. 6 shows a perspective view of a further portion of the left side of the railroad tie plate placement system of FIG. 2.
Figure 7:
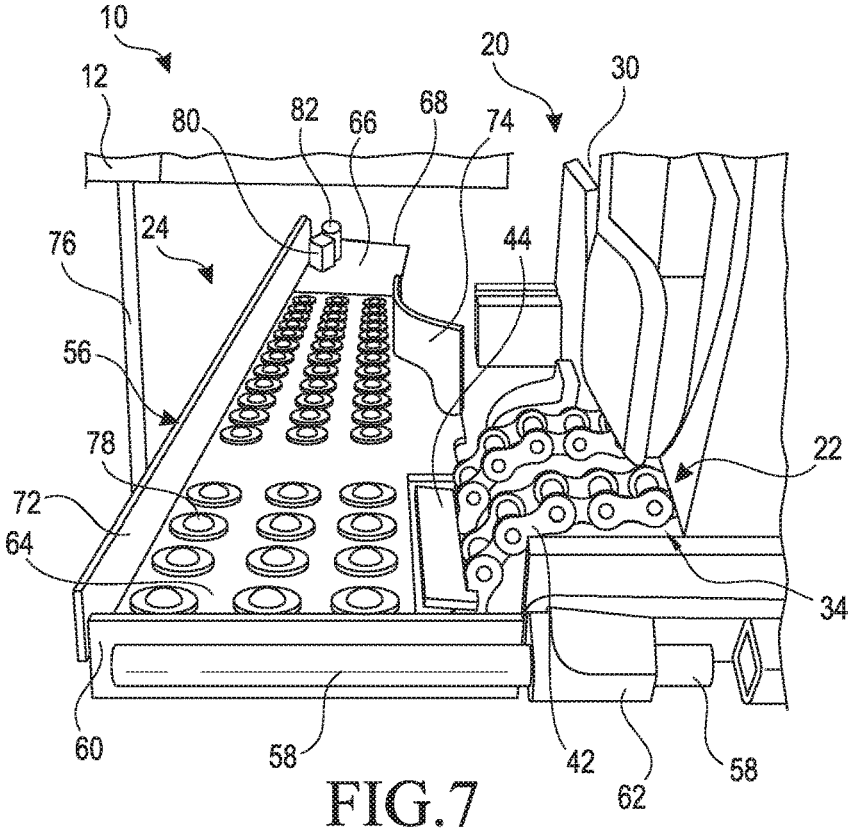
FIG. 7 shows a perspective view of a still further portion of the left side of railroad tie plate placement system of FIG. 2.
Figure 8:
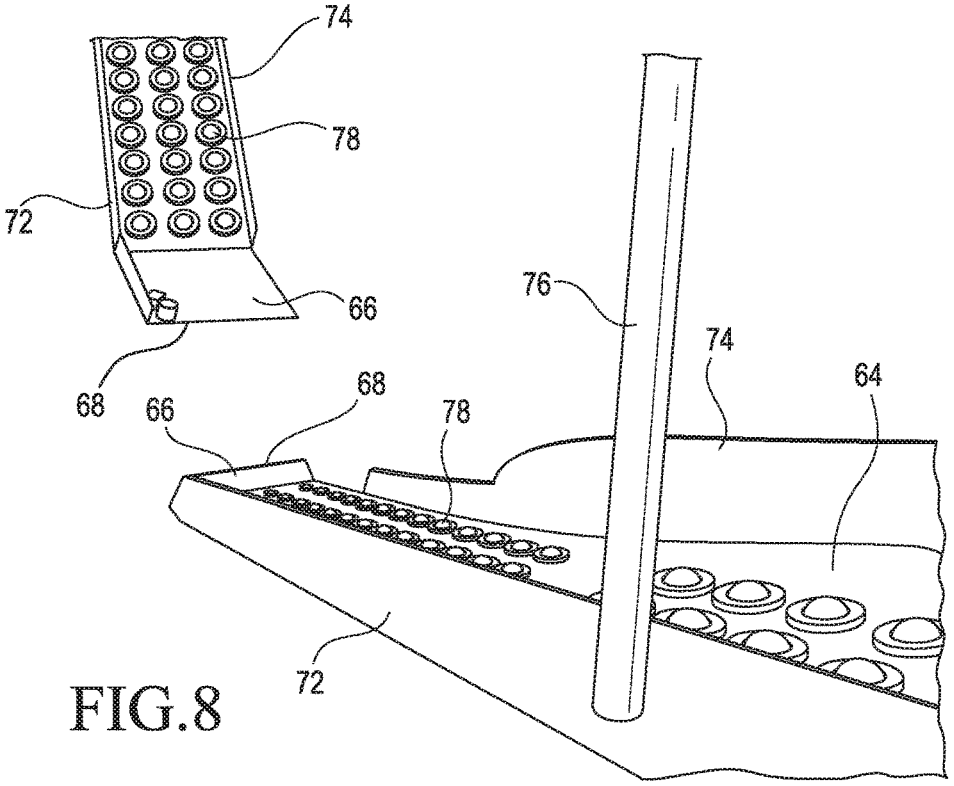
FIG. 8 shows a perspective view of an even further portion of the railroad tie plate placement system of FIG. 2.

FIGS. 6-8 show additional details of chute ramp 56, which can also be described as a slide chute. Chute ramp 56 is supported on transport magazine 30 by an interface between a rod or shaft 58 attached to an end portion 60 of chute ramp 56 and a receiving tube 62 attached to transport magazine 30. Shaft 58 can be attached or affixed to end portion 60 by, for example, welding, or fasteners. Receiving tube 62 can also be affixed to transport magazine 30 by welding or fasteners. Chute ramp 56 is also supported by a connecting element 76 attached to chute ramp 56 and to a portion of vehicle 12. Connecting element 76 can be a rod, shaft, tube, chain, wire, etc. configured to provide support for chute ramp 56, which depends in part on the material used for chute ramp 56; e.g., an aluminum chute ramp will typically require less support than a steel chute ramp.

Figure 17:
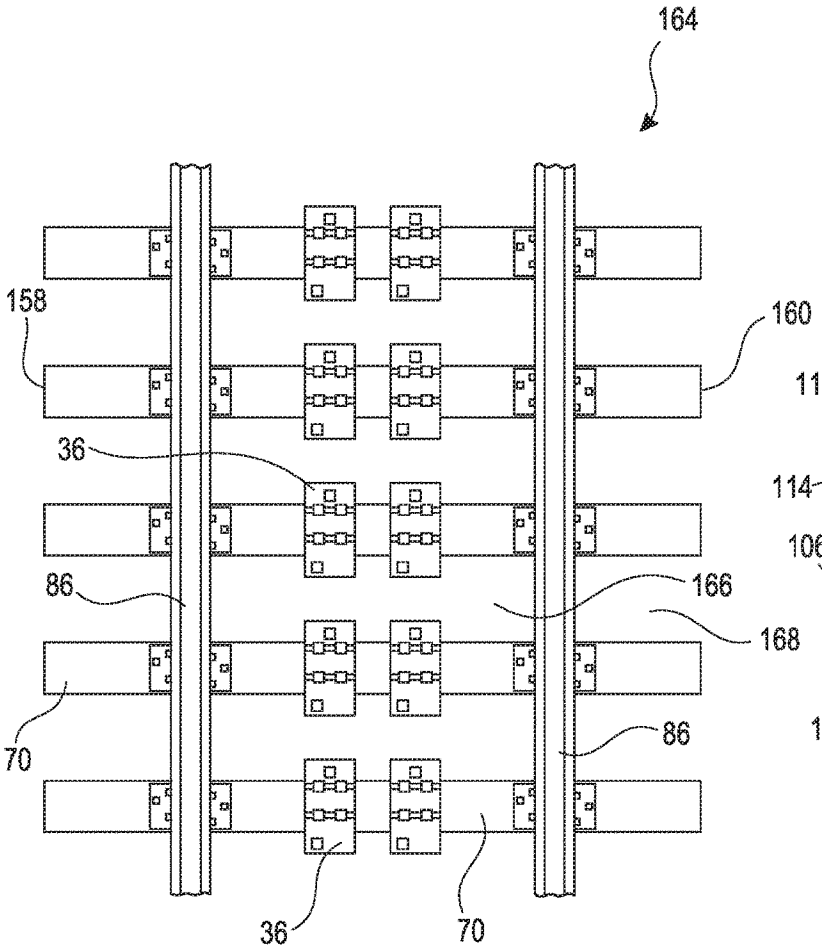
FIG. 17 shows a plan view of railroad or railway track after deposition of railroad tie plates by the system of FIGS. 2-17.
Figure 19:
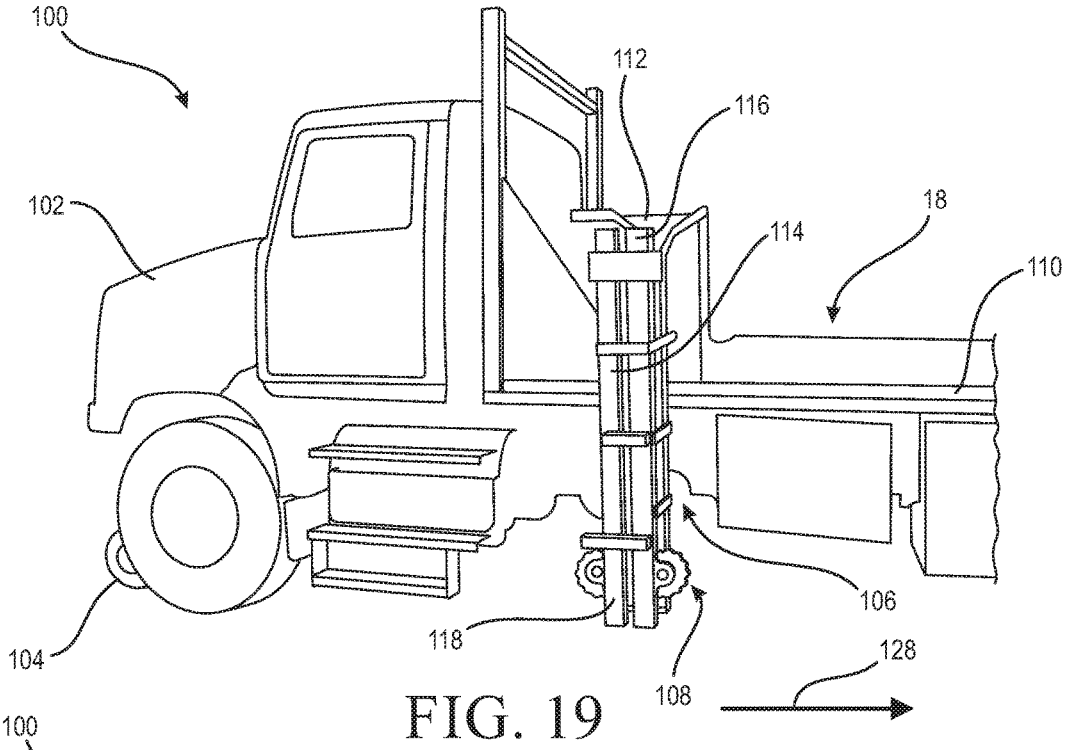
FIG. 19 shows a perspective view of a portion of the railroad tie plate placement system of FIG. 18.

In the exemplary embodiment of, for example, FIG. 6, chute ramp 56 includes a plurality of roller bearings 78 that are spaced to support railroad tie plate 36 as it moves from an upper portion 64 of chute ramp 56 to a lower portion 66 of chute ramp 56, prior to sliding or dropping off an end 68 of chute ramp 56 onto a railroad track, which in the exemplary embodiment of FIG. 17 is on the top of railroad tie 70. It should be understood that roller bearings 78 can be replaced with other elements that reduce and/or control friction, depending on the angle of chute ramp 56 with the ground. Such elements can include, for example, a friction-reducing coating, a friction-reducing surface treatment, and other friction reducing and/or controlling elements.

Chute ramp 56 also includes a first stop wall, stop, guide, or shield 72 that prevents railroad tie plate 36 from sliding off a side of chute ramp 56 when railroad tie plate 36 is pushed from plate transport system 20 to chute ramp 56 of plate deposition system 24. Chute ramp 56 further includes a second guide wall 74 that helps maintain railroad tie plate 36 on chute ramp 56 as it travels a length of chute ramp 56 from upper portion 64 to lower portion 66.

As can be seen in, for example, FIG. 17, railroad tie plate 36 includes a relatively long longitudinal dimension and a relatively short or narrow transverse dimension as compared to the longitudinal dimension. Moving railroad tie plate 36 from upper portion 64 to lower portion 66 is most reliable accomplished when railroad tie plate 36 is oriented such that the longitudinal or long dimension of railroad tie plate 36 is aligned with the longer dimension of chute ramp 56. However, such orientation leads to railroad tie plate 36 being positioned along or parallel to railroad tie 70 rather than perpendicular to railroad tie 70 as shown in FIG. 17. Chute ramp 56 incorporates a feature to provide an approximately 90 degree rotation of railroad tie plate 36 prior to deposition on the railroad bed or track, e.g., on railroad tie 70.

Figure 10:
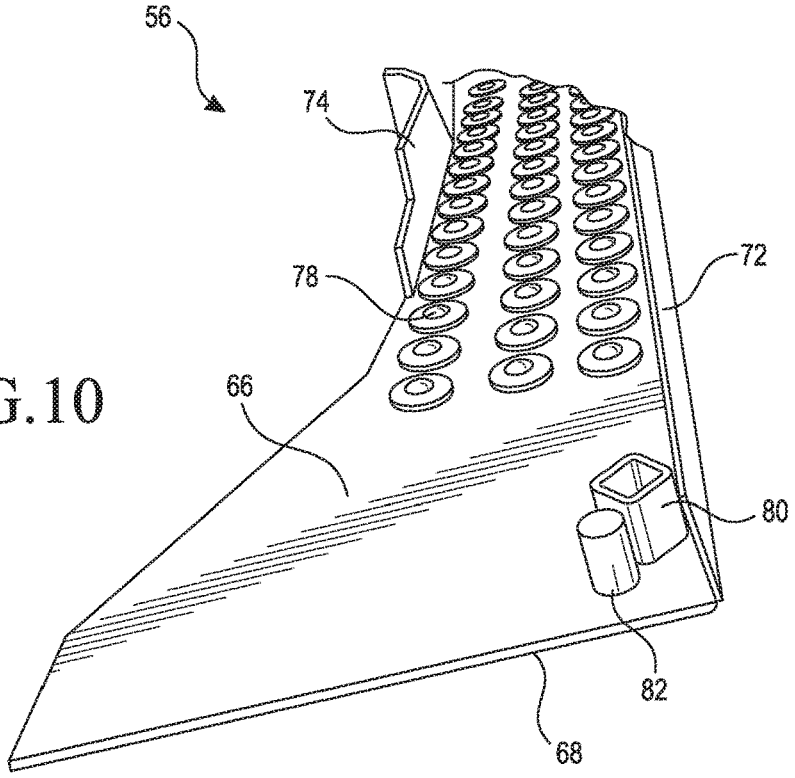
FIG. 10 shows a perspective view of a portion of a chute ramp of the railroad tie plate placement system of FIG. 2.
Figure 12:
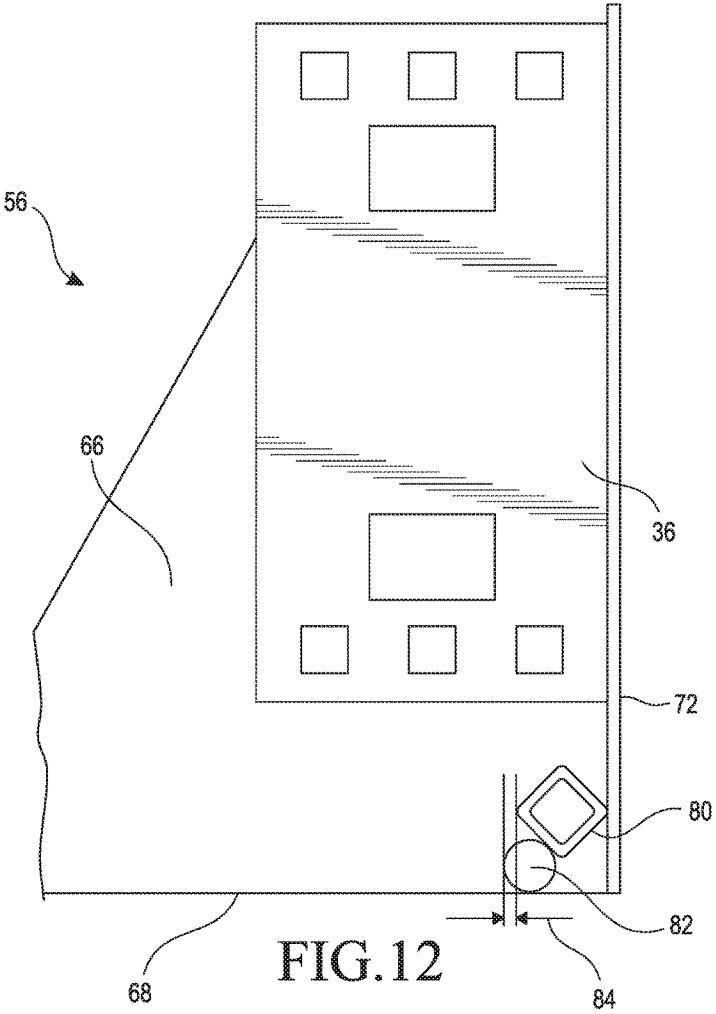
FIG. 12 shows a plan view of a portion of the chute ramp of the railroad tie plate placement system of FIG. 2.
Figure 11:
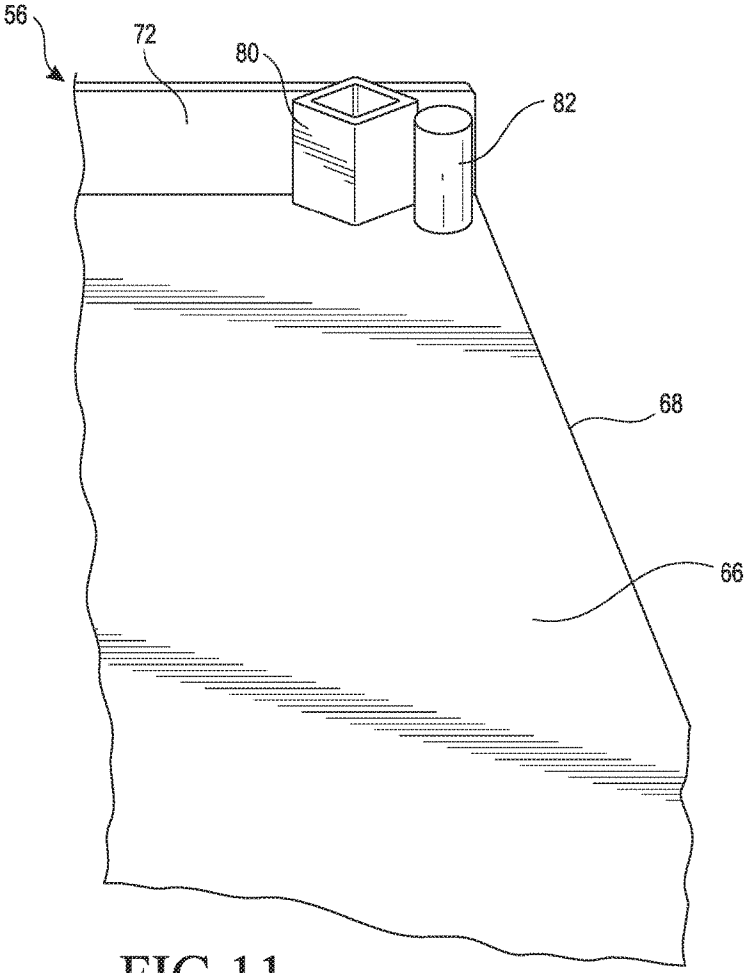
FIG. 11 shows a perspective view of another portion of the chute ramp of the railroad tie plate placement system of FIG. 2.

As shown in, for example, FIGS. 10 and 11, chute ramp 56 includes a stopper arrangement that includes a first stopper 80 and a second stopper 82. First stopper 80 is positioned adjacent to, alongside, near, or close to shield wall 72. In the exemplary embodiment of FIG. 11, first stopper 80 is positioned in contact with shield wall 72, though contact is unnecessary. As shown in FIG. 12, second stopper 82 is positioned below or behind first stopper 80, and offset from first stopper 80 by a predetermined spaced distance 84. Spaced distance 84 depends on a variety of factors, such as the angle of chute ramp 56, the length of lower portion 66, which does not include any bearings, and the type of anti-friction treatment provided to upper portion 64, which determines the speed of railroad tie plate 36 as it reaches first stopper 80 and second stopper 82. In an exemplary embodiment, the amount of offset is in the range of 0.25 to 0.75 inches.

As can be seen in FIG. 11, lower portion 66 is absent any roller bearings 78, and guide wall 74 terminates a distance above lower portion 66. Lower portion 66 is "flared" or widened in a direction that is away from shield wall 72 as chute ramp 56 approaches end 68.

Figure 14:
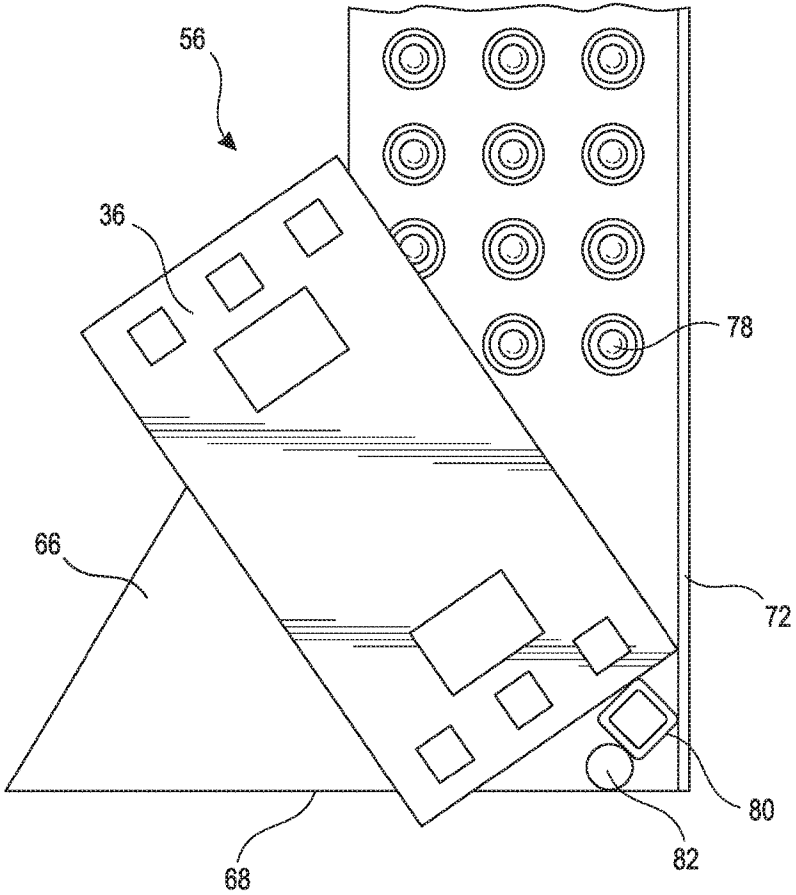
FIG. 14 shows a yet further view of the portion of the chute ramp of FIG. 12.
Figure 13:
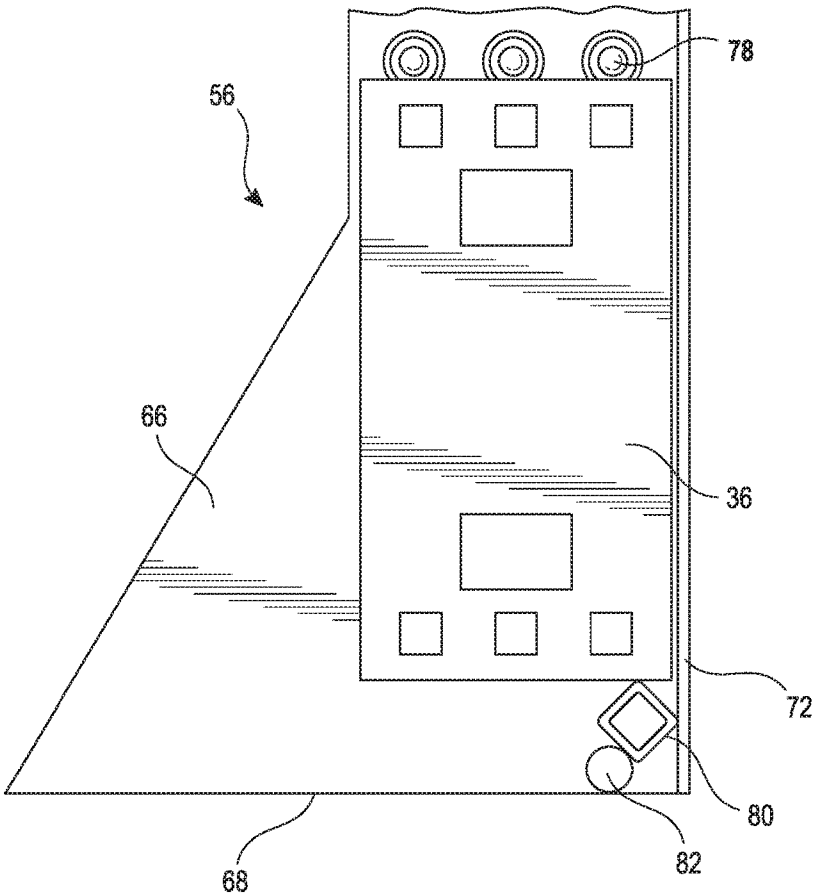
FIG. 13 shows another view of the portion of the chute ramp of FIG. 12.
Figure 16:
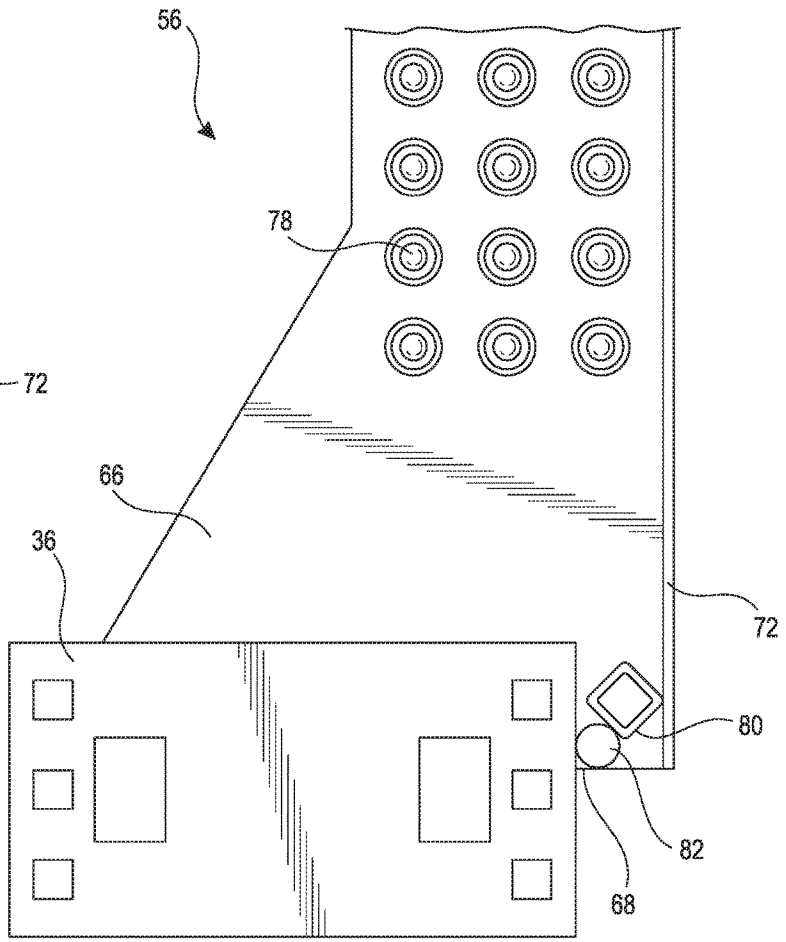
FIG. 16 shows a still even further view of the portion of the chute ramp of FIG. 12.
Figure 15:
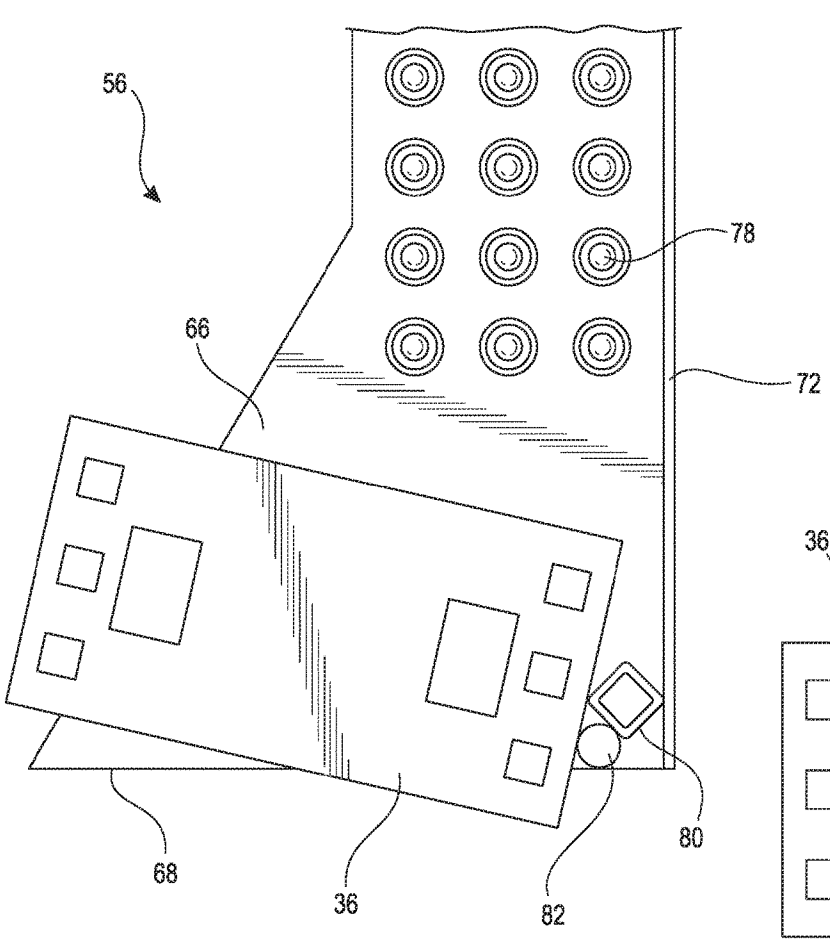
FIG. 15 shows an even further view of the portion of the chute ramp of FIG. 12.
Figure 18:
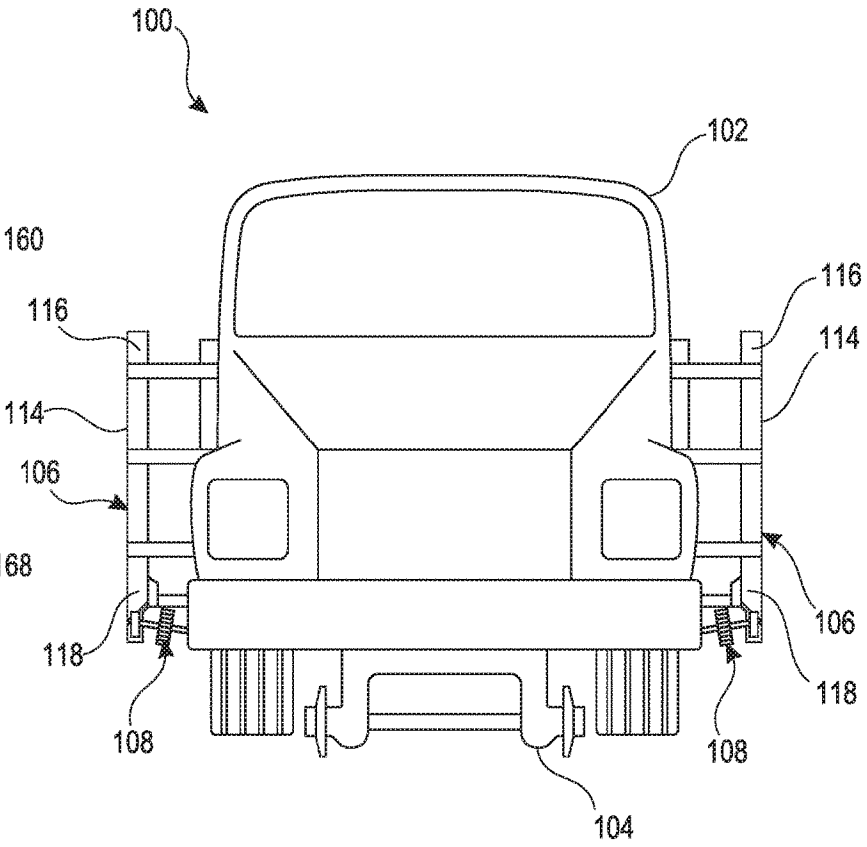
FIG. 18 shows a view of a railroad tie plate placement system in accordance with an exemplary embodiment of the present disclosure.

As a railroad tie plate 36 slides along chute ramp 56 from upper portion 64 to lower portion 66, it picks up speed. As railroad tie plate 36 approaches lower portion 66, it moves from contacting roller bearings 78 to contacting the relatively higher frictional surface of lower portion 66, as shown in FIG. 12. As railroad tie plate 36 moves further, railroad tie plate 36 contacts, hits, or impacts first stopper 80, as shown in FIG. 13. The contact of railroad tie plate 36 with first stopper 80 further slows railroad tie plate 36, but because the contact of railroad tie plate 36 is near a right side of railroad tie plate 36, railroad tie plate 36 begins to rotate around first stopper 80, as shown in FIG. 14. Railroad tie plate 36 continues to rotate around first stopper 80 until railroad tie plate 36 contacts, hits, or impacts second stopper 82, as shown in FIG. 15, which stops most of the rotational momentum of railroad tie plate 36. However, railroad tie plate 36 has sufficient momentum to continue travelling along chute ramp 56 toward and off end 68, as shown in FIG. 16. After sliding off chute ramp 56, which is controlled by the reduction in speed by the contact of railroad tie plate 36 with lower portion 66, first stopper 80, and second stopper 82, railroad tie plate 36 lands onto the railroad bed or track, e.g., on railroad tie 70, in a direction where a long or longitudinal dimension of railroad tie plate 36 is approximately perpendicular or transverse to railroad tie 70, and approximately parallel to rails 86. The position of railroad tie plates is between rails 86, which can be described as a gauge side of rails 86, versus an area on the opposite to the internal area, which can be described as a field side of rails 86.

FIGS. 18-24 show another railroad tie placement system, indicated generally at 100, in accordance with an exemplary embodiment of the present disclosure. Placement system 100 includes a vehicle 102, which includes propulsion system 14 and a high-rail system 104. Placement system 100 also includes plate storage 18, a plate transport system 106, and a plate deposition system 108.

Vehicle 102 can be, for example, a truck, such as a flatbed truck, or a purpose-built vehicle that includes an engine and drive wheels. When vehicle 102 begins as a highway capable vehicle with highway appropriate tires and then has flanged wheels added to it to enable vehicle 102 to operate on train tracks, the added wheels can be described as high-rail system 104.

Plate storage 18, plate transport system 106, plate deposition system 108 will be described in more detail hereinbelow with respect to the following figures.

FIGS. 18-23 show perspective views of portions of placement system 100. Plate storage 18 can be positioned on, for example, a bed 110 of vehicle 102. Plate transport system 106 includes a hopper or loader 112 positioned at, on, near, or adjacent to bed 110. Plate transport system 106 also includes a tie plate magazine or transport magazine 114, which can be positioned on one or both of the left and right sides of vehicle 102. When vehicle 102 includes a left and right tie plate magazine 114 and plate deposition system 108, then railroad tie placement system is configured to deposit a pair of railroad tie plates 36 during operation, though deposition of one or two railroad tie plates 36 can be controlled, as described in more detail hereinbelow.

Transport magazine or box 114 includes a first, upper end 116 and a second, lower end 118. Transport magazine 114 is filled in a stack with a plurality of railroad tie plates 36 (an example of railroad tie plate 36 is shown in FIG. 12) by way of loader 112 in the area of bed 110. Railroad tie plates 36 slide or drop through transport magazine or box 114 from first, upper end 116 down to second, lower end 118 under the force of gravity. Railroad tie plates 36 can be positioned on loader 112 manually or with a device or apparatus.

Figure 21:
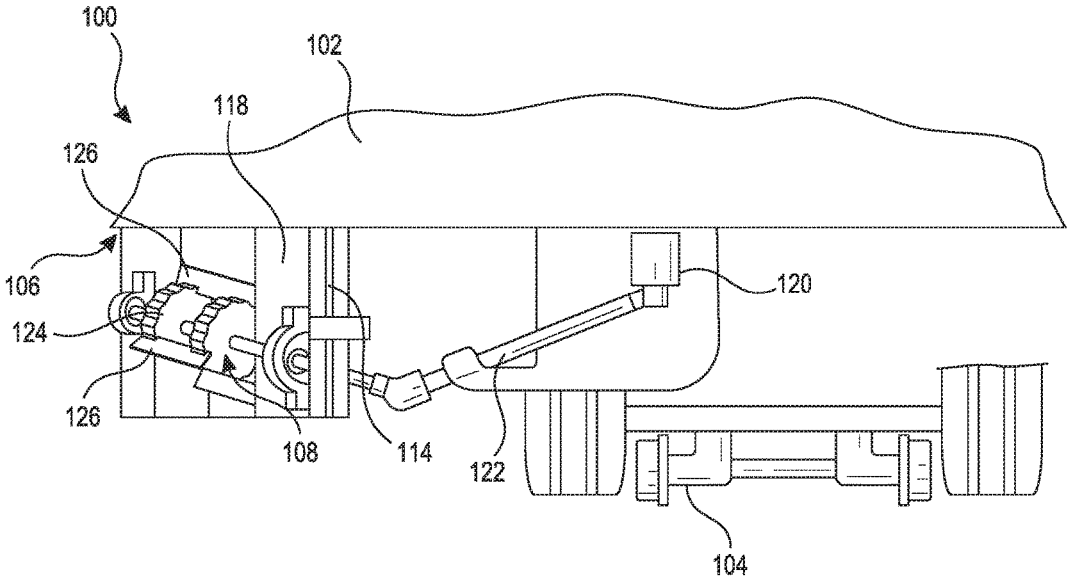
FIG. 21 shows a view of a portion of the railroad tie plate placement system of FIG. 18.
Figure 22:
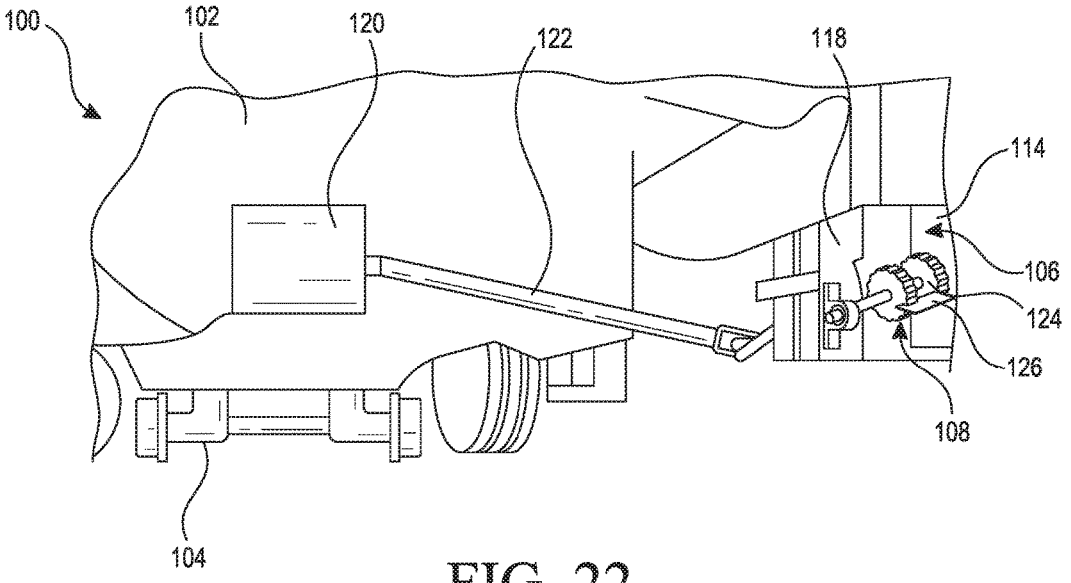
FIG. 22 shows a view of another portion of the railroad tie plate placement system of FIG. 18.
Figure 23:
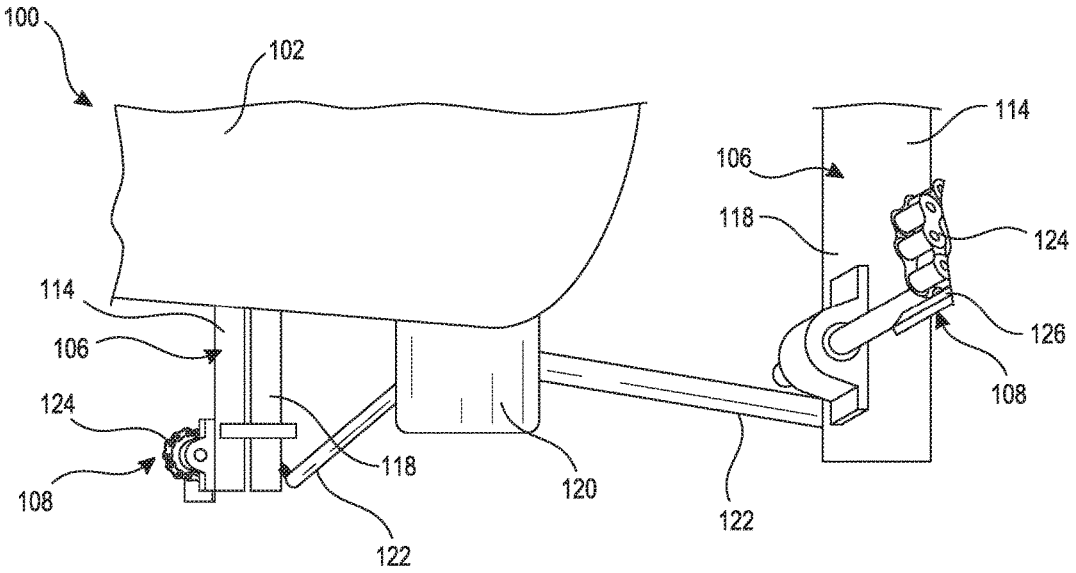
FIG. 23 shows a view of yet another portion of the railroad tie plate placement system of FIG. 18.

Once railroad tie plates 36 drop to second, lower end 118, they are positioned adjacent to plate deposition system 108. Plate deposition system 108 includes a dispenser drive 120. As shown in FIGS. 20-23, a plurality of shafts and U-joints 122 extend from dispenser drive 120 to each of left and right plate deposition system 108. Dispenser drive 120 can be, for example, a hydraulic drive or an electric drive. Each of left and right plate deposition system 108 is driven by dispenser drive 120 by way of a driving connection of shafts and U-joints 122 to each of left and right plate deposition system 108 and driving connection of dispenser drive 120 with left and right plurality of shafts and U-joints 122. One of the left or the right shafts 122 can be longer than the other of the left and right shafts 122, as can be seen in FIGS. 21-23. Thus, dispenser drive 120 can be positioned in an offset or asymmetric location with respect to a centerline of vehicle 102. In an exemplary embodiment, dispenser drive 120 can drive both left and right shafts and U-joints 122 by way of a double ended spindle output of dispenser drive 120, or dispenser drive 120 can include two independently controllable outputs.

Plate deposition system 108 includes a paddle drive or chain drive 124. Chain drive 124 includes a plurality of push plates or paddles 126 that each push or move a single railroad tie plate 36 from second, lower end 118 of transport magazine or box 114 to the ground in an area near an end of railroad tie 70. When dispenser drive 120 causes rotation of shafts and U-joints 122, chain drive 124 of plate deposition system 108 is driven, causing chain drive 124 to move, moving push plates 126 in a direction that is transverse to a vertical direction. In the exemplary embodiment of FIG. 18, the direction of movement of chain drive 124 is along a length of vehicle 102, in a direction that is toward a rear or back 128 of vehicle 102. However, in another embodiment, the movement of chain drive 124 can be toward vehicle 102, which can be effected by way of, for example, rotating chain drive 124 by approximately 90 degrees and connecting a right angle gear box between universal joints and shafts 122 and chain drive 124.

FIG. 20 shows a front view of transport magazine 114 from which railroad tie plates 36 are dispensed by paddles 126 welded to chain drive 124, which is rotated by shafts and U-joints 122. As shown in FIG. 20, an adjustable drop gate 130 can be used to set the height of an opening 132 in transport magazine 114 through which railroad tie plate 36 is dispensed to adjust for different thicknesses of tie plate 36. Transport magazine 114 can also include at least one plate rail 134 protruding from a bottom 136 of transport magazine 114 that supports railroad tie plate 36 while railroad tie plate 36 is pushed out of transport magazine 114 by paddle 126.

Figure 24:
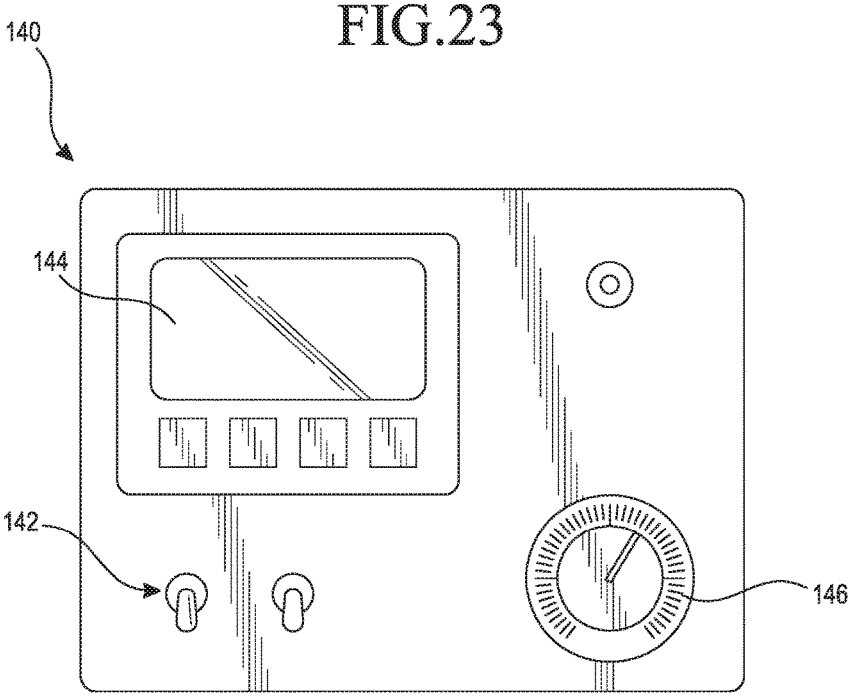
FIG. 24 shows a view of a control panel of the railroad tie placement system of FIG. 18.

FIG. 24 shows a view of a control panel or controller, indicated generally at 140, of placement system 100. Controller 140 is a device for operating dispenser drive 120 to drive left and right chain drives 124. Controller 140 can be located in crow's nest 88 of vehicle 102. Controller 140 can include mode switches 142, a readout screen 144, and a knob 146 for controlling the speed of operation of dispenser drive 120 in a manual mode or a difference dial-in between a sensed speed of vehicle 102 and the speed of dispenser drive 120 in an automatic mode. It should be understood that left and right dispenser drives 120 can be operated in tandem, i.e., at the same time, to deposit railroad tie plates 36. However, in another embodiment, dispenser drive 120 includes independently operable hydraulic motors that can independently or simultaneously drive left and right shafts and U-joints 122.

Figure 25:
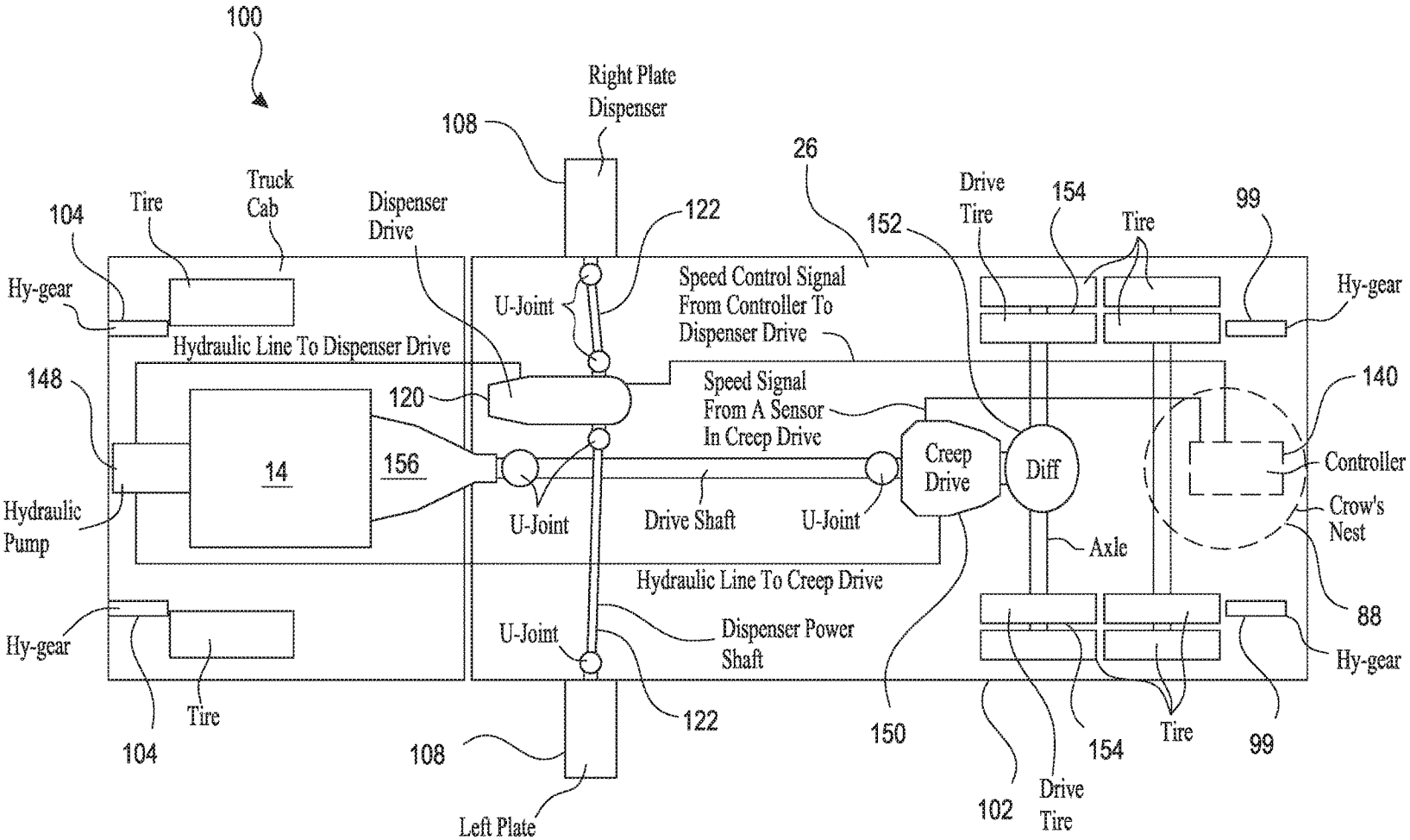
FIG. 25 shows a block diagram of the railroad tie plate placement system of FIG. 18.

FIG. 25 is a schematic view of placement system 100. Placement system 100 includes a hydraulic pump system 148, which is driven by propulsion system 14. Placement system 100 also includes a creep drive 150 and a differential 152. Propulsion system 14 drives differential 152 through creep drive 150. Differential 152 drives at least a pair of drive tires 154. Hydraulic pump system 148 provides pressurized hydraulic fluid to creep drive 150 to propel vehicle 102 when depositing or laying railroad tie plates 36. Hydraulic pump system 148 also provides pressurized fluid to dispenser drive 120. It should be understood that hydraulic pump system 148 can include a plurality of pumps designed to drive specific portions or subsystems of placement system 100. The operator is able to control the speed of dispenser drive 120 by way of control panel 140. Such control may be via one or more valves, via a swash plate control, etc. It should be apparent that dispenser drive 120 and creep drive 150 both include hydraulic motors.

A transmission 156 of propulsion system 14 is in neutral when creep drive 150 is used to turn drive wheels 154 of vehicle 102. When creep drive 150 is used to move vehicle 102 down a railway, a speed sensor within creep drive 150 can provide a speed signal to control panel 140 so a speed control signal can be sent to dispenser drive 120 to automatically control the speed or the dispensing rate of left and right plate deposition systems 108. By automatically controlling dispenser drive 120, plate deposition systems 108 dispense railroad tie plates 36 at a rate commensurate with the speed of creep drive 150.

In the automatic control mode, railroad tie plates 36 will be appropriately dispensed from left and right transport magazines 114 in accordance with the speed of vehicle 102 such that the interval spacing between dispensed railroad tie plates 36 is consistent and constant as vehicle 102 moves along the railway. However, there may be a need to adjust or set a differential between the sensed speed signal of creep drive 150 and the speed control signal sent to dispenser drive 120 in the automatic control mode in the event of variations in the spacing of railroad ties 70, or for other reasons. As shown in FIG. 24, knob 146 can be turned to adjust or control such a speed differential. Varying railway conditions, such as curve, grade, rail smoothness, and bank can create a need for differential adjustments. In manual mode, control panel 140 sends or transmits a speed control signal per a predetermined speed setting without any detection of the speed of vehicle 102. Knob 146 can be used to adjust the predetermined speed setting in the manual mode. Dispenser drive 120 makes left and right plate deposition systems 108 at a rate commensurate with the predetermined speed setting, which can be adjusted by knob 146 on control panel 140 in the manual mode regardless of the speed of vehicle 102.

It should be apparent that the variable drive plate deposition system 108 can interface with the chute ramp configuration of placement system 10 to provide a variable deposition of railroad tie plates 36 for placement system 10.

Figure 26:
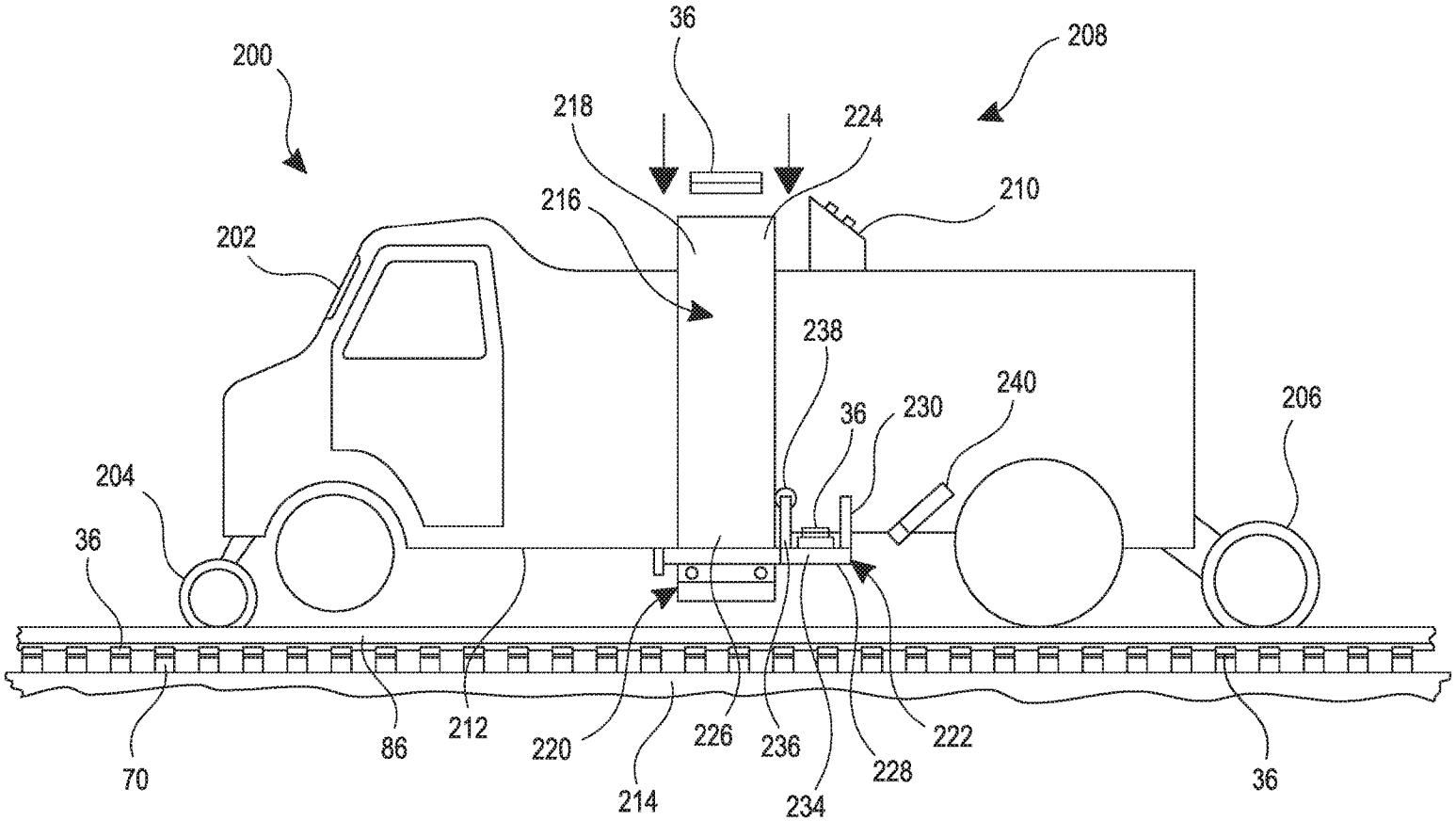
FIG. 26 shows a view of a railroad tie placement system in accordance with an exemplary embodiment of the present disclosure.

FIG. 26 is a view of a vehicle 202 incorporating a railroad tie plate placement system, indicated generally at 200, in accordance with an exemplary embodiment of the present disclosure. Vehicle 202 is configured to include flanged wheels, including a front high-rail assembly 204 and a rear high-rail assembly 206, which can be raised and lowered to configure the vehicle for operation on railroad rails.

Vehicle includes a bed area 208. Bed area 208 is used as a work platform for at least one placement system operator and one or more tie plate magazine loaders. Bed area 208 can also be used to contain a supply of railroad tie plates 36 and to support an operator control platform on which are located a plurality of operator controls, which can be configured as a control panel 210.

Referring to FIGS. 26-30, extending from bed area 208 to an area between a bottom 212 of the vehicle and ground 214 is at least one plate transport system 216, which includes a tie plate magazine 218, which can also be described as a tie plate box. For example, at least one tie plate magazine 218 is positioned on a left side of vehicle 202 and at least one tie plate magazine 218 is positioned on a right side of vehicle 202. Each tie plate magazine 218 includes an upper or top portion 224 where tie plates 36 are loaded, and a lower or bottom portion 226 where a plate transfer system 220 is positioned. Plate transfer system 220 can be similar to plate transfer system 22 or plate deposition system 108. Plate transfer system 220 is driven by an operator-controlled variable drive, such as dispenser drive 120. Plate transfer system 220 moves individual railroad tie plates 36 from plate transport system 216 to a chute ramp 228 included as part of a plate deposition system 222.

Chute ramp 228 can include a shield, stop, or wall 230 that prevents tie plate 36 from falling off a side of chute ramp 228 when loaded onto chute ramp 228 by plate transfer system 220 from tie plate magazine 218. In a raised position, shown in FIGS. 27-29, chute ramp 228 is approximately horizontal to ground 214 to keep railroad tie plate 36 in a stationary, non-moving, or fixed position on chute ramp 228 until the operator is prepared to drop railroad tie plate 36. A bottom 232 of tie plate magazine 218 is also flat or horizontal such that railroad tie plate 36 is properly oriented when moving from tie plate magazine 218 to chute ramp 228.

Figure 29:
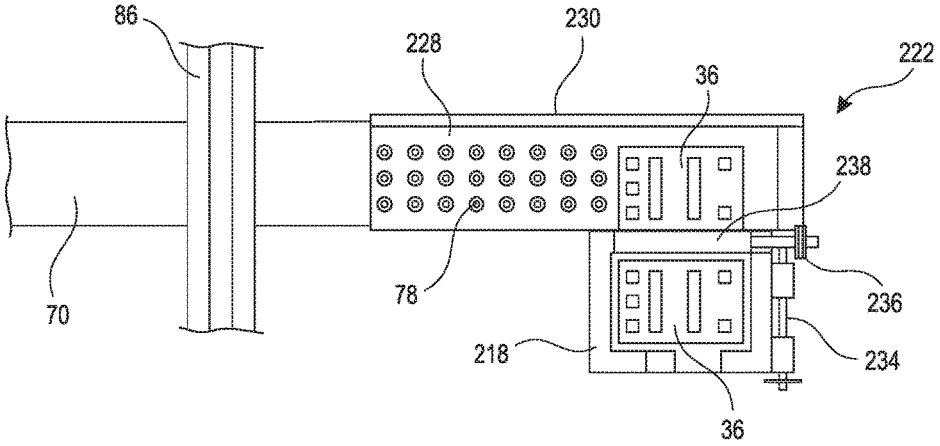
FIG. 29 shows a plan view of the chute ramp of FIG. 28.
Figure 30:
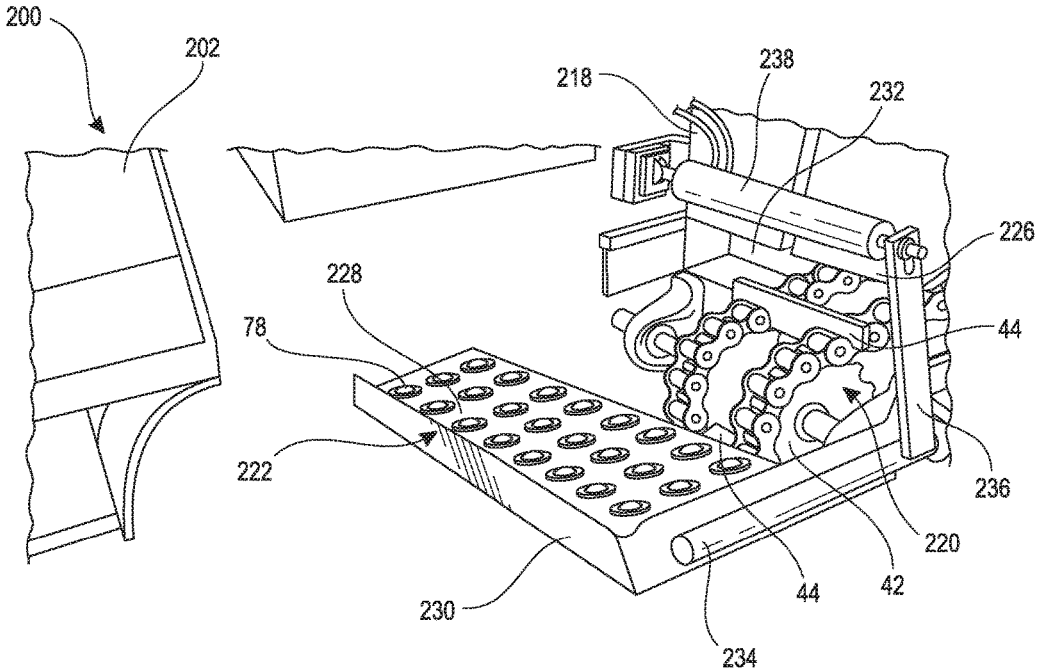
FIG. 30 shows a perspective view of the chute ramp of FIG. 28 with the chute ramp in a second position.
Figure 31:
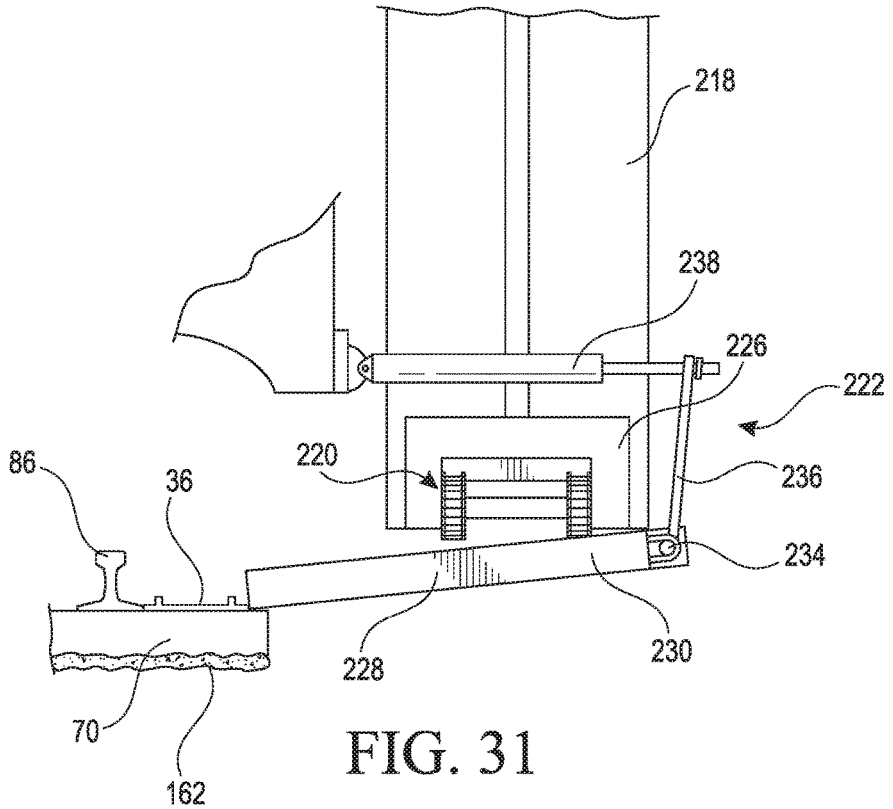
FIG. 31 shows an elevation view of the chute ramp of FIG. 30 positioned along a railroad track.
Figure 32:
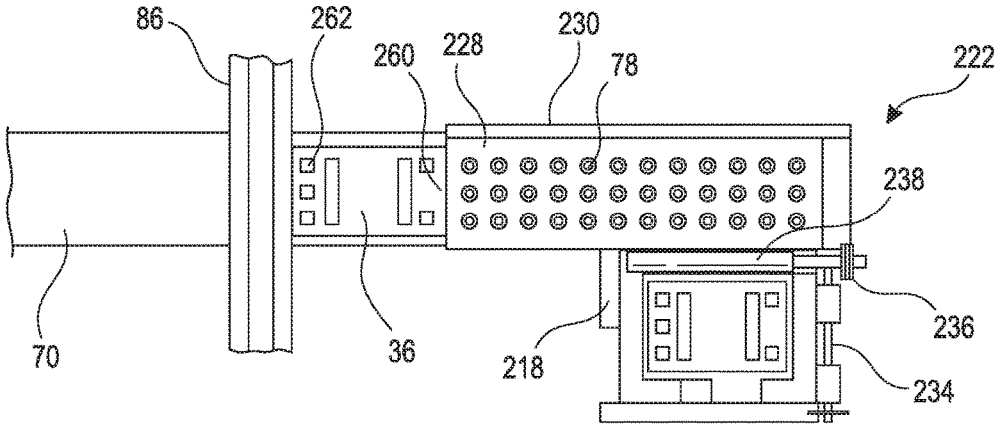
FIG. 32 shows a plan view of the chute ramp of FIG. 31.

Chute ramp 228 is connected to tie plate magazine 218 by way of a rotatably movable shaft 234, which enables chute ramp 228 to be moved from a first, raised position, shown in FIGS. 27-29, to a second, lowered position, shown in FIGS. 30-32. A lever arm 236 is fixedly attached to shaft 234. A movable mechanism 238, such as a pneumatic piston, is supported by tie plate magazine 218, and attached to lever arm 236. Chute ramp 228 is held in position by contact of pneumatic piston 238 with lever arm 236.

Railroad tie plate placement system 200 can also include one or more video systems to enable the operator to determine when and where railroad tie plate 36 needs to be positioned. Such video systems can include at least one camera or other optical sensor 240, positioned on one of a right or a left side of the vehicle, or can include a plurality of cameras or optical sensors 240, with at least one camera or optical sensor 240 on the left side of vehicle 202 and at least one camera or optical sensor 240 on the right side of vehicle 202.

Figure 33:
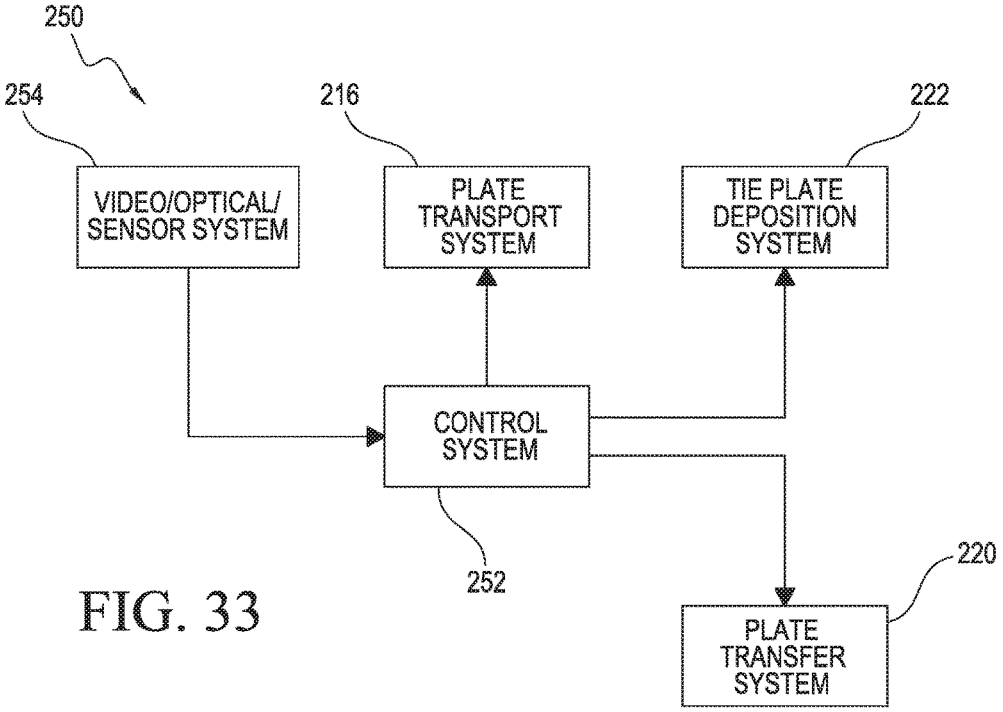
FIG. 33 shows a system level block diagram of the railroad tie placement system of FIG. 26.

FIG. 33 is a block diagram of a railroad tie plate placement system, indicated generally at 250, in accordance with an exemplary embodiment of the present disclosure. Railroad tie plate placement system 250 includes a control system 252, which can include one or more switches, adjustable valves, potentiometers, etc., and a controller including at least one processor and/or application specific circuitry, or other comparable elements, such as fixed circuits configured to operate the various portions of railroad tie plate placement system 250. Railroad tie plate placement system 250 of FIG. 33 further includes an optical or other sensor system 254 positioned to provide information to the operator regarding the location of chute ramp 228 with respect to railroad tie 70. In an exemplary embodiment, the optical system 254 is one or more video cameras, but other sensors can be used, such as ultrasonic, sonic, magnetic, and/or other sensors. Sensors 254 can detect the position of railroad tie 70 to inform the operator that a railroad tie plate 36 needs to be deposited, for example, at a railroad tie 70 that is ready for replacement, or such sensors or system 254 can automatically drop or deposit railroad tie plate 36.

As described elsewhere herein, to move railroad tie plates 36 from the horizontal or flat bottom of tie plate magazine 218 of plate transport system 216 to chute ramp 228 of tie plate deposition system 222, railroad tie plate placement system 250 of FIG. 33 includes plate transfer system 220. In an exemplary embodiment tie plate transport system 216 includes a controllable hydraulic system to facilitate control of, for example, a hydraulic motor. In an alternative embodiment, tie plate transport system 216 includes one or more bi-directional hydraulic pistons. In yet another embodiment, tie plate transport system 216 includes a controllable electric motor.

Once railroad tie plate 36 is positioned on chute ramp 228, railroad tie plate placement system 250 of FIG. 33 includes tie plate deposition system 222 that moves railroad tie plate 36 from a load or first position on chute ramp 228, as shown in, for example, FIG. 29, along chute ramp 228 and onto a predetermined location, such as a top of a railroad tie 70 directly adjacent to a rail, as shown in FIG. 32. In the exemplary embodiment of FIGS. 27-32, railroad tie plate 36 slides down chute ramp 228 until railroad tie plate 36 slides off the end of chute ramp 228 toward rail 86. Rail 86 serves as a stop for railroad tie plate 36, thus positioning railroad tie plate 36 at a proper position for later installation. Tie plate deposition system 222 positions railroad tie plate 36 such that a field side or long side 260 of railroad tie plate 36 is oriented away from both a left and a right rail 86, and a gauge side or short side 262 of railroad tie plate 36 is oriented toward both left and right rails 86.

Figure 34:
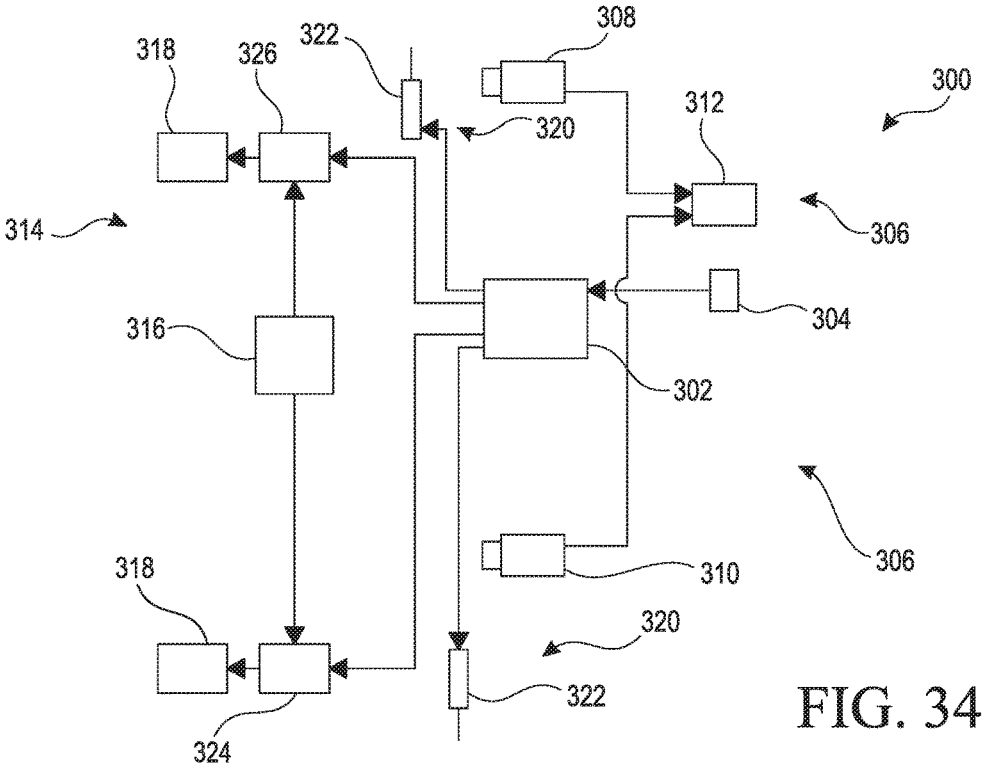
FIG. 34 shows a block diagram of a railroad tie placement system in accordance with an exemplary embodiment of the present disclosure.

FIG. 34 shows a block diagram of a railroad tie plate placement system, indicated generally at 300, in accordance with an exemplary embodiment of the present disclosure. Railroad tie plate placement system 300 includes a control system or apparatus 302 that can include, for example, one or more processors, switches, video splitters and/or switches, hydraulic and/or pneumatic valves, specialized circuits, non-transitory memory, and/or other control elements, including software. Placement system 300 further includes a plurality of operator controls 304, a video/optical/sensor system 306 that can include a plurality of cameras 308 and 310, at least one video monitor or display 312, a plate transport system 314 that includes a hydraulic pump and/or hydraulic accumulator 316 and one or more hydraulic motors 318, and a tie plate deposition system 320 that includes a plurality of pneumatic cylinders 322. However, a single operator interface or control, such as, for example, a joy stick, can be provided to control both plate transport system 314 and plate deposition system 320. In such an embodiment, as an example, a left or right motion of the joy stick could actuate plate transport system 314 to load railroad tie plate 36 into plate deposition system 320. An up and down motion of the joy stick could actuate plate deposition system 320.

The plurality of cameras can include left video camera 310 and right video camera 308, though only one optical sensor or camera can be utilized. Operator controls 304 can include one or more switches, levers, knobs, valves, etc., to control video display(s) 312, camera(s) 308 and 310, hydraulic motor(s) 318, pneumatic cylinders 322, and any other operable feature of placement system 300. Operator controls 304 can communicate directly with controllable elements of placement system 300, or operator controls 304 can communicate with controllable elements by way of control apparatus 302. In addition, operator controls 304 can notify the operator of system conditions by, for example, audio output, video display, vibration, etc.

During operation of the tie plate placement systems of the present disclosure, magazine loaders can position tie plates 36 in at least one of the left and right magazines, with tie plates 36 oriented field side outward or away from the vehicle and gauge side inward or toward the vehicle, and a rail interface side, which is the face side of the tie plate, up. As the vehicle is moving along a railroad track having at least two operable rails, the operator views video monitor or display 312. When the operator identifies a railroad tie 70 that needs a replacement or new tie plate 36, the operator first engages a control to operate tie plate transport system 314. Such control can be, for example, actuating a swash plate control of hydraulic pump 316, actuating a hydraulic valve to connect pressurized fluid from hydraulic pump/accumulator 316 to a single motor that drives plate transport systems 314 on the left and right side of the vehicle, or actuating one of a left hydraulic valve 324 and a right hydraulic valve 326 to direct pressurized hydraulic fluid from hydraulic pump or accumulator 316 to at least one of left hydraulic motor 318 and right hydraulic motor 318. The at least one left hydraulic motor 318 and right hydraulic motor 318 moves a tie plate 36 from the tie plate magazine, such tie plate 36 having been loaded into the magazine by the magazine loader, from the bottom of the tie plate magazine to the upper or top portion of a chute ramp. As previously described, the bottom of the tie plate magazine is horizontal or flat such that the tie plate has approximately the same orientation in the magazine and on the chute. The shield or stop keeps the tie plate from sliding off the edge of the chute. It should be observed that while the bottom of tie plate magazine 218 is horizontal or parallel as shown in FIG. 28, the bottom of tie plate magazine 114 shown in FIG. 20 can be canted or tilted, which can provide advantages in stacking of tie plates 36 in tie plate magazine 114.

Once tie plate 36 is transported from the tie plate magazine to the top of the chute ramp, which requires a short time, such as less than two seconds, the operator is ready to drop tie plate 36. It should be apparent that the vehicle is travelling at a relatively slow speed, measured at inches per second, providing tie plate placement system 300 operator sufficient time to move tie plate 36 from the tie plate magazine to the top of the chute ramp and to actuate tie plate deposition system 320, unless movement of tie plate 36 from the tie plate magazine acts as the deposition system. When the chute ramp is movable and is at a predetermined position or orientation, such as at a position where the chute ramp has moved from a location between two railroad ties 70 to a position that at least partially overlaps railroad tie 70, the operator actuates tie plate deposition system 320, e.g., a control that actuates at least one of left pneumatic cylinder 322 and right pneumatic cylinder 322.

Pneumatic cylinder 322 moves lever 236 of FIGS. 26-32, causing chute ramp 228 to angle downwardly, as shown in FIG. 31. Tie plate 36, which rests on a plurality of friction reducing elements such as bearings 78, slides down chute ramp 228 to the end of chute ramp 228. Tie plate 36 can slide a short distance across railroad tie 70 until contacting rail 86 positioned on railroad tie 70, depending on the coefficient of friction of railroad tie 70 and any damage to railroad tie 70. Deposited railroad tie plate 36 is oriented with the field side oriented outwardly and face side up, ready to be positioned between rail 86 and railroad tie 70 and secured in place by elements such as railroad spikes (not shown). The operator releases the pneumatic cylinder control, which causes pneumatic cylinder(s) 322 to restore lever 236 to its original position, raising chute ramp 228 to an approximately horizontal position to prepare for positioning another tie plate 36 for deposition.

It should be apparent that the ability to control the drop of individual tie plates 36 precisely by controlling the tie plate transport system and/or the tie plate deposition system facilitates compensating for variations in spacing between railroad ties 70, and provides the ability to deposit tie plates 36 adjacent, along, near, at, or directly on only on railroad ties 70 being replaced, rather than on every single railroad tie 70. Such precision is valuable in circumstances where only a portion of railroad ties 70 are being replaced, such as every third railroad tie 70.

It should also be apparent from the foregoing description that magazines on the left side and the right side of the vehicle can be simultaneously operated. However, the systems of the present disclosure can readily be configured to provide individual left and right operation. It should also be understood that left and right and front and back are descriptive of a specific embodiment. In other embodiments, left and right and front and back may be reversed, and in some situations left or right may be positioned in a front or back configuration or location.

Furthermore, while a single magazine on each side is disclosed, a plurality of magazines can be used. In such a configuration, one magazine can be configured to include a first tie plate size and a second magazine on the same side can be configured to include a second tie plate size. Thus, a single vehicle, which may be a truck, can lay a plurality of tie plate sizes without stopping to clear one or both of a left and a right magazine to load a different tie plate configuration. However, a single magazine is readily adjusted for one or more tie plate configurations by installation of a spacer.

It should also be apparent from the figures that the chute ramps disclosed extend in a direction that is generally parallel to railroad ties 70 and generally perpendicular to rails 86. In the context of this disclosure, generally parallel and generally perpendicular are in a range of 0 to about 10 degrees of parallel and perpendicular. While the chute ramps can be at an even greater angle, the greater angle can lead to an undesirable orientation of tie plates 36 with respect to efficiency of installation of tie plates 36. Accordingly, the chosen angle of the chute ramp should be considered in view of the equipment that will be used to install tie plates 36 to maximize efficiency, including minimizing hand labor.

Referring again to FIGS. 17 and 31, it should be understood that the systems, devices, and apparatuses of the present disclosure are configured to deposit railroad tie plate 36 along a railroad track 164. It should be understood that railroad track 164 can include graded and smoothed ground 214, which can be covered by a material such as ballast 162. Ballast 162 is traditionally a crushed rock. Railroad track 164 further includes Railroad ties 70 placed on ballast 162 at spaced distances. Rails 86 are secured to railroad ties 70 by railroad tie plates 36, which provide support for rails 86. When tie plate 36 is positioned between a pair of rails 86 on railroad track 164, the described position 166 is in the grade. When tie plate 36 is positioned on an outside of the pair of rails 86 on railroad track 164, the described position is a field side 168. One advantage of the systems, devices, and apparatuses of the present disclosure is that they are configured to place railroad tie plate 36 in a predetermined position and orientation along railroad track 164 at a location that is between a first end 158 and a second end 160 of railroad tie 70. Furthermore, such position can be between first end 158 and a closer rail 86, and on railroad tie 70; and such position can be in position 166 in the gauge, or between the pair of rails 86, including positioning two railroad tie plates 36 such that a longer dimension of each railroad tie plate 36 is parallel to the direction railroad track 164 extends, which is perpendicular to the transverse width of railroad track 164, and also perpendicular to the direction of dimension of railroad tie 70 between first end 158 and second end 160. Each tie plate can also be positioned on railroad tie 70 when in the gauge.

While various embodiments of the disclosure have been shown and described, it should be understood that these embodiments are not limited thereto. The embodiments may be changed, modified, and further applied by those skilled in the art. Therefore, these embodiments are not limited to the detail shown and described previously, but also include all such changes and modifications.

I claim:

1. A railroad tie plate placement system comprising:

a vehicle including a plurality of flanged wheels sized and dimensioned to support the vehicle on a railroad track having a pair of railroad rails, the railroad rails supported by a plurality of railroad ties, and the vehicle including a left side and a right side;

a bed positioned on the vehicle;

a first chute ramp positioned at least partially in a location under the bed and positioned to extend from the right side of the vehicle toward the left side of the vehicle and a second chute ramp positioned at least partially in a location under the bed and positioned to extend from the left side of the vehicle toward the right side of the vehicle, the first chute ramp including a first end, and the second chute ramp including a second end, wherein tie plates are deposited from the first end of the first chute in a direction towards the left side of the vehicle and tie plates are deposited from the second end of the second chute in a direction towards the right side of the vehicle; and a system positioned on the vehicle and configured to deliver the railroad tie plates to the first chute ramp and the second chute ramp.

2. The railroad tie plate placement system of claim 1, wherein each of the first and second chute ramps is configured to guide the railroad tie plate from the first end and the second end, respectively, to deposit the railroad tie plate on one of the plurality of railroad ties.

3. The railroad tie plate placement system of claim 2, wherein each of the first and second chute ramps is configured to deposit the railroad tie plate on the railroad tie on a field side of the pair of rails.

4. The railroad tie plate placement system of claim 3, wherein each of the first and second chute ramps is configured to deposit the railroad tie plate on the railroad tie with a gauge side of the railroad tie plate closer to one of the pair of rails than to an end of the railroad tie and with a field side of the railroad tie plate closer to the end of the railroad tie than to either of the pair of rails.

5. The railroad tie plate placement system of claim 1, wherein each of the first and second chute ramps is at a fixed angle with respect to a horizontal plane.

6. The railroad tie plate placement system of claim 1, wherein the each of the first and second chute ramps is movable between a first position causing the railroad tie plate to be stationary on the respective first and second chute and a second position causing the railroad tie plate to move along the respective first and second chute ramp.

7. The railroad tie plate placement system of claim 1, wherein each of the first and second chute ramps extends from the one of the left side and the right side toward the pair of railroad rails at an angle that is within ten degrees of perpendicular to the pair of railroad rails.

8. The railroad tie plate placement system of claim 1, wherein the system for placing the railroad tie plate on the first and second chute ramps positions a subsequent railroad tie plate at the respective first and second chute ramps at a predetermined interval.

9. The railroad tie plate placement system of claim 1, wherein the system for placing the railroad tie plate at each of the first and second chute ramps is controlled by an operator.

10. The railroad tie plate placement system of claim 1, wherein the vehicle includes a retractable high-rail system.

11. The railroad tie plate placement system of claim 1, wherein each of the first and second chute ramps is configured to rotate the railroad tie plate by approximately 90 degrees to orient the railroad tie plate parallel to the rails and perpendicular to the railroad tie before depositing the railroad tie plate on the railroad tie such that a long side of the railroad tie plate extends in a same direction as the rails.

12. The railroad tie plate placement system of claim 1, wherein each of the first and second chute ramps is configured to deposit the railroad tie plate between the pair of rails.

13. A system for depositing a railroad tie plate on a railroad track that includes a pair of rails and a plurality of railroad ties, the system comprising:

a vehicle having a left side and a right side, the vehicle configured to be supported by the pair of rails; and a first chute ramp positioned to extend from the right side of the vehicle toward the left side of the vehicle and a second chute ramp positioned to extend from the left side of the vehicle toward the right side of the vehicle, the first chute ramp being configured to receive the railroad tie plate at the right side and to deposit the railroad tie plate towards the left side on the railroad track from an end of the first chute ramp, and the second chute ramp being configured to receive the railroad tie plate at the left side and to deposit the railroad tie plate towards the right side on the railroad track from an end of the second chute ramp such that the railroad tie plates are deposited on the railroad track at a location that is between the end of the first chute ramp and the end of the second chute ramp.

14. The railroad tie plate placement system of claim 13, further including a plate transfer system configured to place the railroad tie plate on one of the first and second chute ramps at the one of the left side and the right side.

15. The railroad tie plate placement system of claim 14, wherein the plate transfer system is driven by a flanged wheel that engages at least one of the pair of rails.

16. The railroad tie plate placement system of claim 14, wherein the plate transfer system is driven by a variable speed drive.

17. The railroad tie plate placement system of claim 13, wherein each of the first and second chute ramps is oriented at a fixed angle with respect to a horizontal plane.

18. The railroad tie plate placement system of claim 13, wherein each of the first and second chute ramps is movable between a first position causing the railroad tie plate to be stationary on the respective first and second chute ramp and a second position causing the railroad tie plate to move along the respective first and second chute ramp.

19. The railroad tie plate placement system of claim 18, wherein each of the first and second chute ramps is configured to rotate the railroad tie plate by approximately 90 degrees before depositing the railroad tie plate on the railroad tie.

20. The railroad tie plate placement system of claim 18, wherein each of the first and second chute ramps is configured to deposit the railroad tie plate between the pair of rails.

21. The railroad tie plate placement system of claim 18, wherein each of the first and second chute ramps is configured to deposit the railroad tie plate on the railroad tie on a field side of the pair of rails.

22. The railroad tie plate placement system of claim 21, wherein each of the first and second chute ramps is configured to deposit the railroad tie plate on the railroad tie with a gauge side of the railroad tie plate closer to a nearest one of the pair of rails and with a field side of the railroad tie plate closer to an end of the railroad tie than to either one of the pair of rails.

* * * * *